US005588811A

United States Patent [19]

Price

[11] Patent Number: 5,588,811

[45] Date of Patent: Dec. 31, 1996

[54] AIR BED DIAPHRAGM PUMP

[75] Inventor: Gerald H. Price, Burlington, Canada

[73] Assignee: Price Manufacturing, Inc., Burlington, Canada

[21] Appl. No.: 275,125

[22] Filed: Jul. 14, 1994

[51] Int. Cl.[6] ..... F04B 1/28; F04B 39/10

[52] U.S. Cl. ..... 417/350; 417/412; 417/413.1; 417/473

[58] Field of Search ..... 417/413.1, 412, 417/473, 350; 92/48

[56] References Cited

U.S. PATENT DOCUMENTS

| | | | |
|---|---|---|---|
| 1,737,387 | 11/1929 | Redmond | 417/413.1 X |
| 2,660,384 | 11/1953 | Smith | 417/350 X |
| 2,809,868 | 10/1957 | Thompson | 417/473 X |
| 2,991,723 | 7/1961 | Zubaty | 92/48 X |
| 4,507,058 | 3/1985 | Schoenmeyr | 417/271 X |
| 4,570,833 | 2/1986 | Vanderjagt | 417/269 X |
| 4,610,605 | 9/1986 | Hartley | 417/269 |
| 4,801,249 | 1/1989 | Kakizawa | 92/48 X |
| 4,971,523 | 11/1990 | Wacker et al. | 417/413.1 |

FOREIGN PATENT DOCUMENTS

| | | | |
|---|---|---|---|
| 588283 | 12/1959 | Canada | 417/350 |
| 62-291484 | 12/1987 | Japan | 417/413.1 |
| 3-64679 | 3/1991 | Japan | 417/412 |

*Primary Examiner*—Richard E. Gluck
*Attorney, Agent, or Firm*—Howard J. Greenwald

[57] ABSTRACT

A diaphragm pump comprised of a shaft, means for rotating the shaft at a speed of less than 3,000 revolutions per minute, a first connecting rod connected to a first diaphragm and operatively connected to the shaft, a second connecting rod connected to a second diaphragm and operatively connected to the shaft, and means for converting rotary motion of the shaft into reciprocating linear motion of both the first connecting rod and the second connecting rod such that, as the first connecting rod is moved in a first direction at a first rate of travel, the second connecting rod is simultaneously moved in a second linear direction at a second rate of travel, which is equal to said first rate of travel, and wherein the second linear direction is the opposite of the first linear direction.

11 Claims, 17 Drawing Sheets

AIR BED DIAPHRAGM PUMP

FIELD OF THE INVENTION

A diaphragm pump adapted for use with an air sleep system equipped with an internal inflation apparatus for controlling the firmness of the air core within the air sleep system.

BACKGROUND OF THE INVENTION

Air beds have become an increasingly popular sleeping system. Thus, it appears that the "Air Sleep System" manufactured by the Select Comfort Corporation of Minneapolis, Minnesota is purchased by at least about 50,000 consumers per year in the United States. At least three other manufacturers sell comparable air sleep systems.

The "Air Sleep System" sold by Select Comfort Corporation utilizes an air mattress described in U.S. Pat. No. 4,908,895 of Robert A. Walker. This air mattress is comprised of a top wall, a bottom wall spaced from and located below the top wall, side walls and end walls secured to said top and bottom walls, all of said walls comprising flexible air impervious sheet members sealed together along the edge portions thereof to form a chamber for accommodating air under pressure, seam means securing adjacent portions of the sheet means together, a pair of longitudinal first support means located in said chamber extended between said end walls adjacent the side walls and secured to said top and bottom walls providing longitudinal passages accommodating air, a plurality of transverse second support means located in said chamber extended between said pair of first support means and secured to said top and bottom walls providing transverse passages for accommodating air, said first and second support means limiting outward expansion of the top and bottom walls when air under pressure is stored in said chamber; each of said first and second support means having a continuous web section and opposite end portions, an opening adjacent each of said end portions allowing air communication between said transverse and longitudinal passages, the opposite end portions of said first support means longitudinally spaced from said end walls, and the opposite end portions of said second support means laterally spaced from the web sections of the first support means to provide said openings, first tube means mounted in the seam means in one end of the air mattress to facilitate supplying air under pressure to said chamber, an elongated flexible and elastic tube connected to the first tube means and adapted to be connected to a supply of air under pressure to selectively carry air under pressure to said chamber and retained under pressure within said tube, and second tube means mounted in the seam means in a second end of the air mattress, and air pressure relief valve means connected to said second tube means in communication with said chamber and atmosphere whereby air is vented from said chamber through said valve means when the pressure of the air within the chamber exceeds a selected maximum limit. The entire disclosure of this Walker patent is hereby incorporated by reference into this specification.

Similar air mattresses are contained in the air sleep systems sold by other manufacturers. See, e.g, U.S. Pat. No. 4,394,784 of Gerald R. Swenson et al., U.S. Pat. No. 300,194 of Robert A. Walker, and the like. The disclosure of each of these United States patents is hereby incorporated by reference into this specification.

The aforementioned "Air Sleep System," and the aforementioned comparable air sleep systems, also utilize a motor-driven impeller which is disposed outside of said air bed and is connected to the air mattress by tubing. In the use of such air sleep systems, it is common to locate the impeller beneath the air bed on the floor below it together with the appropriate control mechanisms. When the user wishes to adjust the firmness of the mattress, he may reach to the floor, pick up the control, activate the impeller, and either deliver or release air from the mattress.

Air may be released from the "Air Sleep System" by moving the control in one direction and activating only the relief valve. Air may be inserted into the "Air Sleep System" by moving the control in another direction and activating both the motor-driven impeller and the relief valve.

The motor driven impeller is excessively noisy; it is similar in design to a vacuum cleaner motor, and it is equally offensively loud. This often causes a problem when one user, during the middle of the night, decides to adjust the firmness of such an "Air Sleep System." It has been reported that many domestic quarrels have been caused by an unsuspecting spouse suddenly being awakened by the sound of such a motor-driven impeller.

Furthermore, in addition to creating an unseemly amount of noise, it is often difficult to gain access to the relatively large motor driven impeller unit, especially after it has been coated with several layers of dust under the bed. Furthermore, the location of wires, hoses, and a motor driven impeller under the air bed creates cleaning problems under the bed, is inconvenient to use with certain types of headboard and bed assemblies, and often is aesthetically displeasing.

In many hospital settings, beds are used where the head of the bed is movable from a horizontally up to a vertical or substantially vertical position. The need for external wires, tubes, and pumps in the "Air Sleep System" renders such system impractical for such a use.

For any or all of these reasons, and notwithstanding the fact that Select Comport Corporation reportedly is spending millions of dollars in direct mail advertising, the Select Comfort "Air Sleep System" has met with a substantial amount of consumer resistance. Select Comfort Corporation sells their system with a money-back guarantee, and it appears that at least about ten percent of the systems so sold are returned. It appears that the majority of the systems so returned are returned because the motor-driven impeller is too noisy and/or too bulky and/or inconvenient to use.

The prior art has disclosed the Select Comfort "Air Sleep System," and similar airbeds, must be used in conjunction with an external air source. Initial prior art designs involving an internal air source were abandoned in favor of later designs with an external air source, and such later designs have been in use in the industry since at least as early as 1983.

In 1980, U.S. Pat. No. 4,224,706 was issued to Gary A. Young et al. on an application filed in Oct. 16, 1978. This patent disclosed a bed assembly comprised of internal bellows within the foundation for an mattress. The bellows were connected to a rod 112 which, in turn, was connected to a handle 114. At column 4 of this patent, at lines 63 et seq., it was disclosed that "An electric motor can be coupled to the rod 112 in place of handle 114. Such an electric motor could be supported within or outside of the support structure 12."

The design of this patent presented several practical difficulties. The bellows assembly used was relatively large and, thus, had to be disposed within the foundation for the airbed and could not be incorporated within the airbed itself. Consequently, because at least about forty percent of all airbeds are sold without foundations (and are adapted to be used with a consumer's existing foundation), the design of U.S. Pat. No. 4,224,706 could not be sold to large segments of the airbed mattress industry.

On Nov. 14, 1979, Gary A. Young et al. filed another patent application on the design first disclosed in U.S. Pat. No. 4,224,706; this latter application issued as U.S. Pat. No. 4,306,322 on Dec. 22, 1981. At lines 12–15 of column 5 of U.S. Pat. No. 4,306,322, it is also disclosed that "An electric motor can be coupled to the rod 112 in the place of the handle 114. Such an electric motor could be supported within or outside of the support structure 12."

The airbeds disclosed in Young et al.'s U.S. Pat. Nos. 4,224,706 and 4,306,322 were never marketed by the assignee of such patents, Dial-A-Firm, Inc.; the design of these airbeds was impractical, expensive, and unappealing to consumers. Prior to July of 1981, Dial-A-Firm, Inc. went bankrupt.

A new company (Dial-A-Firm International, Inc.) was formed by Gary A. Young et al. prior to July of 1981, and on Jul. 8, 1981 a new patent application was filed on an "Air Bed with Firmness Control"; this application was issued as U.S. Pat. No. 4,394,784 on Jul. 26, 1983.

The air bed system of U.S. Pat. No. 4,394,784 is comprised of (1) an air bladder confined within a mattress, (2) an air blower having an intake to atmospheric air and having an exhaust to atmospheric air and having a pressurized air outlet, (3) an air line connected to the pressurized air outlet and connected to the air bladder, (4) an air valve interposed in the air line for selectively opening and closing air flow therethrough, (5) means for actuating the air valve for opening air flow through the air line and for energizing the air blower, and (6) means for actuating the air valve for opening air flow through the air line and for deenergizing the air blower. The entire disclosure of this patent is hereby incorporated by reference into this specification.

The design of U.S. Pat. No. 4,394,784 revolutionized the air bed industry. Every air bed sold since 1983 with an inflation system is described by the claims of this patent.

However, it is clearly disclosed in U.S. Pat. No. 4,394,784 that, with the design of such patent, an external air source must be used. Thus, at lines 44–47 of column 1 of the patent, it is disclosed that "The present invention utilizes an air mattress assembly of a particular and preferred construction, in combination with an externally energized and powered air pressure source."

One reason that the air bedding system of U.S. Pat. No. 4,394,784 (and, in addition, all air bedding systems sold since 1983 with an air inflation system) utilizes an external powered air pressure source is that, when one desires to increase the firmness of the air mattress, air must flow into the mattress at a sufficiently high rate so the increase in firmness will occur within a reasonably short period of time. A consumer will not want to wait fifteen minutes for the firmness of a mattress to be adjusted but will want such adjustment to occur within a matter of seconds.

In order to produce the required flow rate, all of the air bed systems sold since 1983 use an external pump which is relatively large and bulky. In general, the minimum dimension of such external pumps is at least 6 inches. Thus, because of their size, these pumps cannot readily be incorporated within air mattresses, which generally have widths of less than four inches.

Furthermore, in addition to being too large, the pumps which produce a sufficient amount of air flow are also very noisy. Even if these pumps could be incorporated within the air mattresses, the noise produced during their operation would offend most consumers, many of whom are on the mattress while it is being inflated.

It is an object of this invention to provide an air sleep system which contains pump means disposed within the air bed. However, several problems are presented with such a design.

In the first place, if air pumps currently used with air beds were to be reduced in size so that they could fit within the bed, they would not have enough power to generate the desired air flow within a reasonable period of time.

In the second place, even if the air pumps currently used with air beds could be reduced in size so that they could fit within the air mattress while still producing enough power, they would have to be operated of relatively high speeds to produce such power and, thus, would produce even more unacceptable noise than is being produced by the currently unacceptable host of air mattress pumps.

The problems associated with a redesign of air mattress pumps are illustrated by U.S. Pat. No. 4,829,616. In 1989, in his U.S. Pat. No. 4,829,616, Robert A. Walker attempted to provide a reciprocating diaphragm pump which would improve upon the operation of the impeller pumps then (and now) being used with air sleep systems; see, e.g., FIG. 2 of such patent and lines 37 et seq. of Column 5 thereof. However, the reciprocating diaphragm pump of this Walker patent (and of corresponding Walker U.S. Pat. Nos. 4,890,344 and 4,897,890) was still unacceptably noisy and never was put to commercial use.

There was an additional problem with the reciprocating diaphragm pump of the Walker patents. Whereas air flow from the prior art impeller pumps automatically decreases as pressure within the air mattress is increased, such is not the case with the Walker diaphragm pumps; and, absent some sort of safety release valve, there was a danger of over-inflation and destruction of the air mattress. Furthermore, because of its relatively bulky size, the Walker diaphragm pumps could not be disposed within conventional air mattresses.

It is an object of this invention to provide a diaphragm pump which can be used to inflate an air mattress and, during such inflation, will operate readily quickly and quietly.

It is another object of this invention to provide a diaphragm pump which can be disposed within and operate suitably within conventional air mattresses.

It is an object of this invention to provide an air sleep system comprised of a pump which is disposed within an air bed.

It is another object of this invention to provide an air sleep system which is relatively quiet when it is being used to inflate the air core of the system.

It is yet another object of this invention to provide an air sleep system which automatically prevents over-inflation of the air core during the time air is being supplied to such core.

It is yet another object of this invention to provide an air sleep system which is relatively inexpensive to produce.

It is yet another object of this invention to provide an air sleep system which, when one user moves upon the mattress comprising said system, air is not transversely transferred to another portion of the mattress to thus disturb another user.

It is yet another object of this invention to provide an air sleep system whose controls are mounted on at least one side of the air bed.

It is yet another object of this invention to provide an air sleep system whose controls are detachably mounted on at least one side of the air bed.

It is yet another object of this invention to provide an air sleep system which may be controlled by a remote control device;

It is yet another object of this invention to provide an air sleep system comprised of an air pump which can readily be connected or disconnected from an air mattress.

SUMMARY OF THE INVENTION

In accordance with this invention, there is provided a diaphragm pump containing a shaft, means for rotating the shaft at a speed less than about 3,300 revolutions per minute, a flange connected to the shaft and disposed thereto at an angle other than 90 degrees, and a pair of connecting rods attached to said flange.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 30 is a perspective view of the mattress assembly of FIG. 28;

PREFERRED EMBODIMENTS OF THE INVENTION

Figure 1:
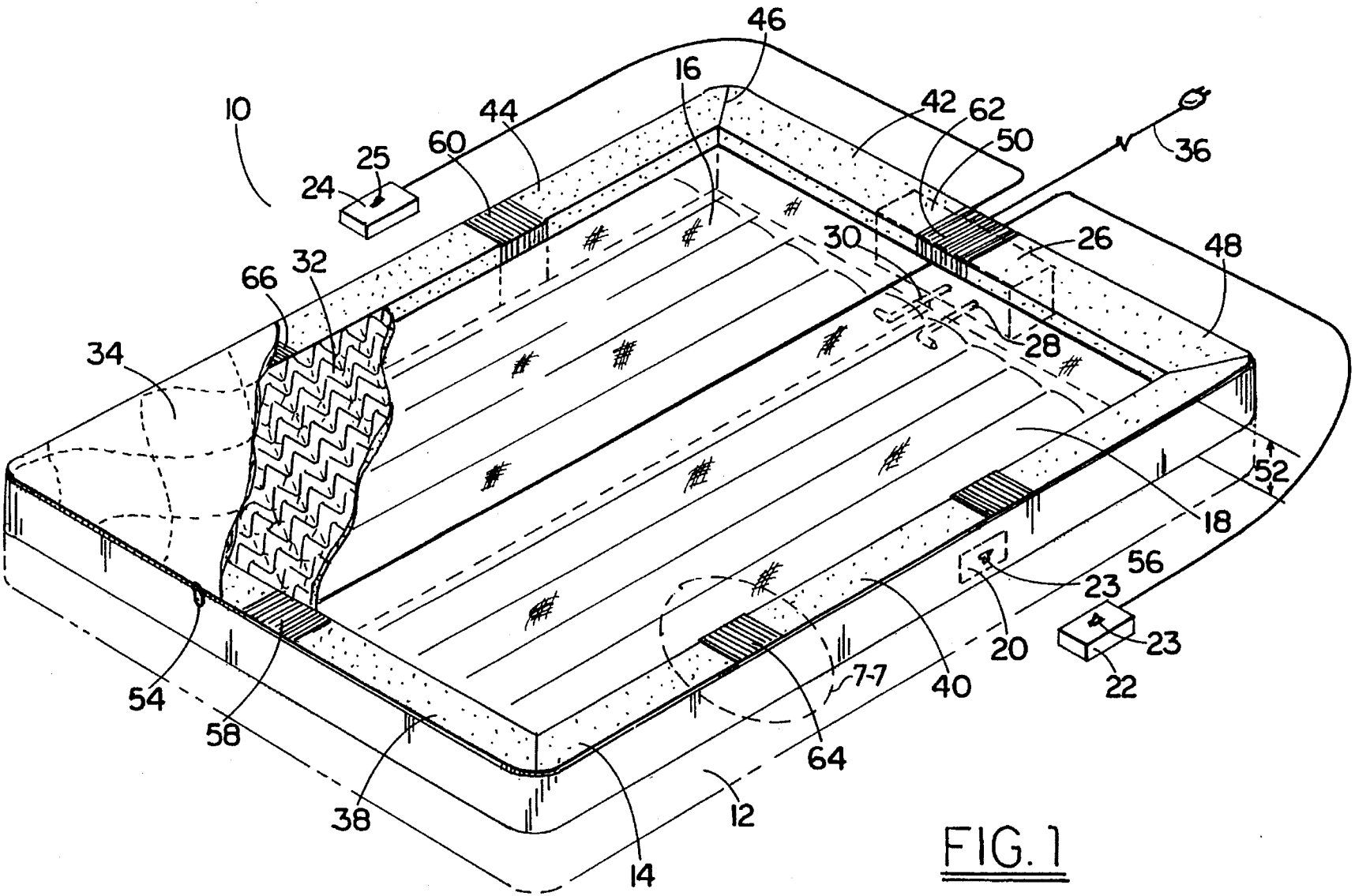
FIG. 1 is schematic view of one preferred embodiment of applicant's air sleep system.

The diaphragm pump of this invention may be used with any conventional air mattress system.

In one especially preferred embodiment, the diaphragm pump may be used in conjunction with the air mattress disclosed and claimed in U.S. Pat. No. 4,394,784 of Gerald R. Swenson et al.; the entire disclosure of this patent is hereby incorporated by reference into this specification.

U.S. Pat. No. 4,394,784 discloses, and claims: "An air bed system having firmness control of an air bladder confined within a mattress, comprising (a) an air blower having an intake to atmospheric air and having an exhaust to atmospheric air, and having a pressurized air outlet; (b) an air line connected to said pressurized air outlet and connected to said air bladder; (c) an air valve for selectively opening and closing air flow therethrough; (d) means for actuating said air valve for opening flow through said air line and for energizing said air blower; and (e) means for actuating said air valve for opening air flow through said air line and for deenergizing said air blower" (see claim 1).

In other embodiments, one or more of the airbeds disclosed in the patents cited during the prosecution of U.S. Pat. No. 4,394,784 may be used in conjunction with applicant's diaphragm pump. Thus, by way of further illustration but not limitation, one or more of the airbeds disclosed in U.S. Pat. No. 3,303,518 of Ingram, U.S. Pat. No. 4,078,842 of Zur, U.S. Pat. No. 4,224,706 of Young et al., U.S. Pat. No.

4,306,322 of Young et al. and/or in German patent 1529538 may be used in applicant's claimed apparatus. The disclosure of each of these patents is hereby incorporated by reference into this specification.

In another preferred embodiment, the diaphragm pump is used in conjunction with the air mattress assembly described in U.S. Pat. No. 4,908,895; the entire disclosure of such patent is hereby incorporated by reference into this specification.

U.S. Pat. No. 4,908,895 describes an air mattress which contains a chamber and, located with such chamber, a ". . . plurality of transverse webs . . . " In particular, this patent discloses and claims "An air mattress accommodating air under pressure for providing support for a body comprising: a top wall, a bottom wall spaced from and located below the top wall, side walls and end walls secured to said top and bottom walls, all of said walls comprising flexible air impervious sheet members sealed together along the edge portions thereof to form a chamber for accommodating air under pressure, seam means securing adjacent portions of the sheet members together, a pair of longitudinal first support means located in said chamber extended between said end walls adjacent the side walls and secured to said top and bottom walls providing longitudinal passages accommodating air, a plurality of transverse second support means located in said chamber extended between said pair of first support means and secured to said top and bottom walls providing transverse passages for accommodating air, said first and second support means limiting outward expansion of the top and bottom walls when air under pressure is stored in said chamber; each of said first and second support means having a continuous web section and opposite end portions, an opening adjacent each of said end portions allowing air communication between said transverse and longitudinal passages, the opposite end portions of said first support means longitudinally spaced from said end walls, and the opposite end portions of said second support means laterally spaced from the web sections of the first support means to provide said openings, first tube means mounted in the seam means in one end of the air mattress to facilitate supplying air under pressure to said chamber, an elongated flexible and elastic tube connected to the first tube means and adapted to be connected to a supply of air under pressure to said chamber and retain air under pressure within said tube, and said second tube means mounted in the seam means in a second end of the air mattress, and air pressure relief valve means connected to said second tube means in communication with said chamber and atmosphere whereby air is vented from said chamber through said valve means when the pressure of the air within the chamber exceeds a selected maximum limit."

In other preferred embodiments, one or more of the airbeds disclosed in the patents cited during the prosecution of U.S. Pat. No. 4,908,895 may be used in conjunction with applicant's diaphragm pump. Thus, by way of further illustration but not limitation, one may use one or more of the airbeds disclosed in U.S. Pat. No. 300,194 of Walker, U.S. Pat. No. 486,696 of Curlin, U.S. Pat. No. 1,282,980 of Takach, 1,730,752 of Withers, 2,000,873 of Arens, 2,236,587 of Williams, U.S. Pat. No. 2,237,012 of Sampson, U.S. Pat. No. 2,415,150 of Stein, U.S. Pat. No. 2,542,781 of Sawyer, U.S. Pat. No. 2,549,597 of Harris et al., U.S. Pat. No. 2,604,641 of Morner, U.S. Pat. No. 2,614,272 of Morner, U.S. Pat. No. 2,741,780 of Kimbrig, U.S. Pat. No. 2,919,747 of Post, U.S. Pat. No. 3,128,480 of Lineback, U.S. Pat. No. 3,705,429 of Nail, U.S. Pat. No. 3,780,388 of Thomas et al., U.S. Pat. No. 3,790,975 of Phillip et al., U.S. Pat. No. 3,867,732 of Morrell, U.S. Pat. No. 4,225,989 of Corbett et al., U.S. Pat. No. 4,306,322 of Young et al., U.S. Pat. No. 4,394,784 of Swenson et al., U.S. Pat. No. 4,541,135 of Karpov, U.S. Pat. No. 4,631,767 of Carr et al., U.S. Pat. No. 4,644,597 of Walker, and U.S. Pat. No. 4,682,378 of Savenije. The entire disclosure of each of these United States patents is hereby incorporated by reference into this specification.

In yet another preferred embodiment, applicant's diaphragm pump may be used in conjunction with the air bed assemblies disclosed in one or more of U.S. Pat. Nos. 5,170,522, 4,897,890 4,644,597, 5,144,706, 4,890,344, 4,788,729, 4,991,244, 4,829,612, 4,766,628, 300,194, and 313,973. The disclosure of each of these patents is hereby incorporated by reference into this specification, In yet another preferred embodiment, applicant's diaphragm pump is used in conjunction with the air bed disclosed in U.S. Pat. No. 5,105,488, the entire disclosure of which is hereby incorporated by reference into this specification.

In yet another embodiment, the hospital air bed disclosed in U.S. Pat. No. 4,803,744 (the entire disclosure of which is hereby incorporated by reference into this specification) may be used in conjunction with applicant's diaphragm pump.

In yet another patent, the diaphragm pump may be used in conjunction with the air bed systems disclosed in U.S. Pat. Nos. 4,986,738 and 5,062,169.

FIG. 1 is a perspective view of a preferred air bedding system 10 of this invention. Referring to FIG. 1, and in the preferred embodiment illustrated, it will be seen that air bed system 10 is comprised of optional foundation 12, mattress edge support 14, first air mattress 16, second air mattress 18, flush-mounted hand control 20, first hand-held hand control 22, second hand-held hand control 24, diaphragm pump 26, air hose 28, hose 30, convoluted foam topper 32, mattress cover 34, and electrical cord 36.

As will be apparent to those skilled in the art, the air bedding system 10 is similar in many respects to the air bed 10 of U.S. Pat. No. 4,394,784.

Referring to FIG. 1, it will be seen that, in the preferred embodiment illustrated, air bedding system 10 has a foundation 12 such as, e.g., a box spring which may be constructed according to well-known techniques. Thus, e.g., one may use one or more of the box springs disclosed in U.S. Pat. Nos. 5,083,329, 5,070,556, 5,052,064, 5,009,417, 4,995,125, 4,979,251, and the like. The disclosure of each of these patents is hereby incorporated by reference into this specification.

As will be apparent to those skilled in the art, one may use other mattress foundations or furniture items such as, e.g., platform beds, Captains beds, bunk beds, posture foundations, waterbed pedestals, a floor, and the like.

In one embodiment, the bed foundation disclosed in U.S. Pat. No. 5,144,706 may be used as foundation 12. Alternatively, one may use one or more of the foundations of U.S. Pat. Nos. 64,175, 1,853,111, 2,518,983, 4,128,907, 4,391,008, 4,402, 097, 4,675,929, 4,679,261, 4,696,071, and 4,734,946. The disclosure of each of these patents is hereby incorporated by reference into this specification.

Referring again to FIG. 1, mounted on foundation 12 is mattress edge support 14. As is known to those skilled in the art, the function of mattress edge support 14 is to provide support for one sitting or sleeping on the side of the mattress and, furthermore, confine air core mattresses 16 and 18.

In one preferred embodiment, mattress edge support 14 consists essentially of foam material. As is known to those skilled in the art, foam materials are materials with a spongelike, cellular structure and include, e.g., sponge rubber, plastic foams, latex foams, polyurethane foams, and the like.

It is preferred that the mattress edge support 14 be comprised of polyurethane foam. As is known to those skilled in the art, urethane foams are made by adding a compound that produces carbon dioxide or by reaction of a diisocyanate with a compound containing active hydrogen. See, e.g., page 874 of George S. Brady et al.'s "Materials Handbook," Thirteenth Edition (McGraw-Hill, Inc., New York, 1991).

In one preferred embodiment, the polyurethane foam used is a flexible foam with a density of from about 1 pound per cubic foot to about 5 pounds per cubic foot and, preferably, has an independent load deflection (ILD) of from about 20 to about 80.

Any conventional foam edge support may be used in the air bedding system of FIG. 1. Thus, by way of illustration and not limitation, one may use the "Border for Air Bed" disclosed and claimed in U.S. Pat. No. 4,991,244 and/or the air bed borders disclosed and/or claimed in U.S. Pat. Nos. 1,730,752, 2,691,179, 3,128,480, 3,735,432, 3,736,604, 4,187,566, 4,224,706, 4,306,322, 4,394,784, 4,637,082, 4,682,378, 4,713,852, 4,879,775, 4,890,344, 4,897,890, and the like. The disclosure of each of these patents is hereby incorporated by reference into this specification.

Referring to FIG. 1, and to the preferred embodiment illustrated therein, it will be seen that mattress edge support 14 is preferably comprised of segments 38, 40, 42, and 44 which may be joined together by means discussed elsewhere in this specification.

In one preferred embodiment, illustrated in FIG. 1, each of segments 38, 40, 42, and 44 is mitered at its edge (such as, e.g., edge 46) and is preferably covered with a flexible fabric material 48.

Referring again to FIG. 1, it will be seen that, in this embodiment, diaphragm pump 26 is disposed within an opening 50 (whose outlines are shown in dotted line). As will be apparent to those skilled in the art, because opening 50 cannot exceed the dimensions of segment 42, the diaphragm pump 26 must have a maximum width which is less than the width of segment 42. In practice, it is preferred to have at least about 0.5 inches of foam surrounding each side of diaphragm pump 26. Thus, when as is conventional, the height 52 of segments 40 and 42 are about 6 inches, the maximum height of diaphragm pump 26 must be no more than about 5 inches. It is preferred however, to use a diaphragm pump whose width is no greater than about 4 inches.

Referring again to FIG. 1, it will be seen that air flowing from diaphragm pump 26 flows through air hoses 28 and 30 from ports 220 and 222 (see FIG. 12) and thence into air cores 16 and 18. One preferred method of such connection is described elsewhere in this specification.

Any of the air cores known to those skilled in the art may be used as air cores 16 and 18. Thus, by way of illustration and not limitation, and referring to U.S. Pat. No. 4,908,895 (see column 2), "A plurality of transverse sheet beams or webs are secured to the top and bottom walls to maintain the air mattress in a box-like shape. A pair of longitudinal sheet beams or webs are secured to the top and bottom walls between the outer ends of the transverse webs and the side walls of the air mattress. The longitudinal and transverse webs stabilize side to side mattress sway motion and eliminate uneven areas on the top wall of the air mattress. The opposite ends of the transverse and longitudinal webs have openings to allow air to flow into and out of the transverse and longitudinal air chambers. The walls and webs can be nylon fabric and vinyl plastic or cotton fabric and rubber sheet materials sealed together. These sheet materials are air impervious and form seals that do not tear or rip apart in use."

As will be apparent to those skilled in the art, the air cores 16 and 18 depicted in FIG. 1 are similar to the air mattress 20 described in U.S. Pat. No. 4,908,895 with the exception that the latter air mattress contains transverse webs whereas the former air mattresses do not.

By way of further illustration and not limitation, one may use one or more of the air cores described in U.S. Pat. Nos. 300,194, 4,788,729, 4,644,597, 4,371,999, 4,986,738, 5,062,169, 4,788,729, 4,394,784, 4,305,425, 4,225,989, 4,224,706, 4,175,297, 4,169,295, 4,149,285, 4,129,145, and the like. The disclosure of each of these patents is hereby incorporated by reference into this specification.

Air bedding systems comprising air cores 16 and 18, which are similar in configuration to the air bedding system 10, are commercially available and may be purchased from, Dynatech, Inc. of Greenville, S.C. as the "Comfortaire Air Bed."

Referring again to FIG. 1, and in the preferred embodiment depicted, it will be seen that a resilient foam topper 32 is disposed on top of air cores 16 and 18 and within segments 38, 40, 42, and 44 to protect such air cores 16 and 18 and increase the comfort of the assembly. It is preferred that topper 32 be comprised of flexible polyurethane foam with a density of from about 1 to about 5 pounds per cubic foot. It is also preferred that topper 32 be secured within segments 38, 40, 42, and 44 by a friction fit.

A mattress cover 34, which preferably is quilted on its tops and side, is disposed over topper 32, the top surfaces of segments 38, 40, 42, and 44, the outside surfaces (not shown) of segments 38, 40, 42, and 44, the bottom surface (not shown) of segments 38, 40, 42, and 44, and the undersides (not shown) of air cores 16 and 18. The mattress cover 34 may be preferably be closed by conventional means such as, e.g., a zipper 54, "VELCRO" loop and hook fastening means (not shown), a draw string (not shown), permanent sewing (not shown), and the like.

In the preferred embodiment illustrated in FIG. 1, rail straps 58, 60, 62, 64, and 66 are used to fasten cover 34 to one or more of segments 38, 40, 42, and 44.

Referring again to FIG. 1, hand-held controller 22 may be used to either insert air into or withdraw air from air core 18; and, similarly, controller 24 may be used to control the flow of air into air core 16. Each of these controllers 22 and 24 is comprised of a switch (such as switches 23 and 25). In one position, each of such switches activates diaphragm pump 26 and causes air to flow into the air mattress. In another position, each of such switches activates a solenoid (not shown) and allows air to exhaust from the air mattress.

In the embodiment illustrated in FIG. 1, in addition to hand-held controllers 22 and 24, the assembly 10 also is comprised of a controller 20 which is mounted within segment 40 of the edge support system 14. The flush-mounted controller 20 serves the same function as does the hand controllers 22 and 24.

In another embodiment, not shown, hand controller 22 is replaced by flush mounted controller 20 and, optionally, hand controller 24 is replaced by a comparable flush-mounted controller (not shown).

Figure 2:
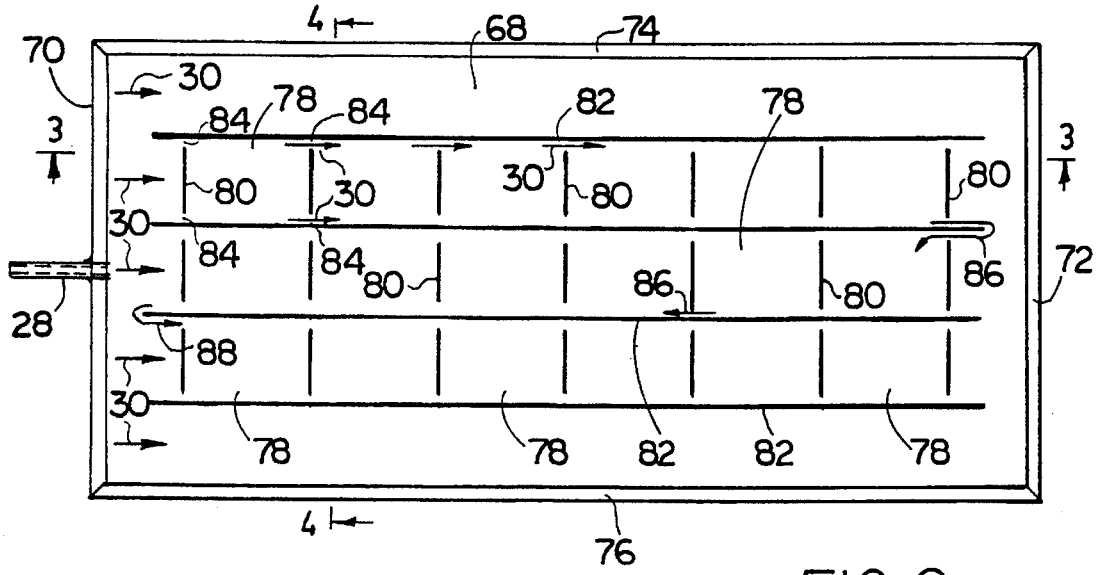
FIG. 2 is a top view of the air mattress used in the system of FIG. 1, with the baffle design of such mattress indicated by dotted lines.

FIG. 2 is a top view of an air core 17 which, in many respects, is similar to the air core 16 of FIG. 1. Referring to FIG. 2, it will be seen that air core 17 is comprised of a multiplicity of fabric 68 which extends from front edge 70 to back edge 72, and from side edge 74 to side edge 76.

Within fabric 68 a multiplicity of air compartments 78 which are formed by baffles 80 and longitudinally-extending beams 82.

Air may flow into (or out of) air hose 28. For the purpose of illustration, the discussion will relate to air inflow, it being obvious that the reverse process can occur in the reverse direction.

Referring again to FIG. 2, air may flow through air hose 28 in the directions of arrows 38.

The transversely-extending baffles 80 do not completely extend from one side of beam 82 to another. Thus, referring to a portion of FIG. 2, it will be seen that air may flow around openings 84 formed between the ends of baffles 80 and the interior walls of beams 82. Additionally, air may flow in the direction of arrows 86 and 88. It will be apparent to those skilled in the art that, because air is free to flow past all of the baffles 80 and into each of the air compartments 78, the air pressure in each of said compartments will be substantially equal once an equilibrium pressure been attained.

Figure 3:
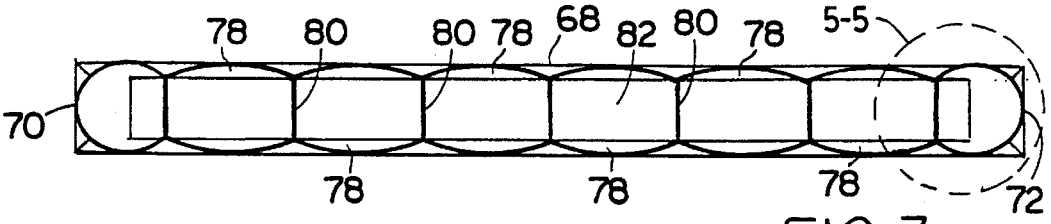
FIG. 3 is a side view of the air mattress of FIG. 2.
Figure 4:
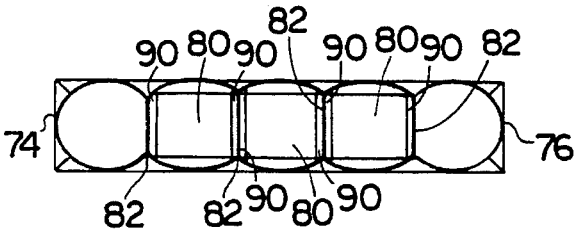
FIG. 4 is an end view of the air mattress of FIG. 2.

FIG. 3 is a longitudinal sectional view of air mattress 17. FIG. 4 is a transverse sectional view of air mattress 17. Referring to FIG. 4, it will be seen that air may flow in the direction of arrows 84, 86, and 88 (see FIG. 2) though openings 90 formed between the ends of baffles 80 and the beams 82.

Figure 5:
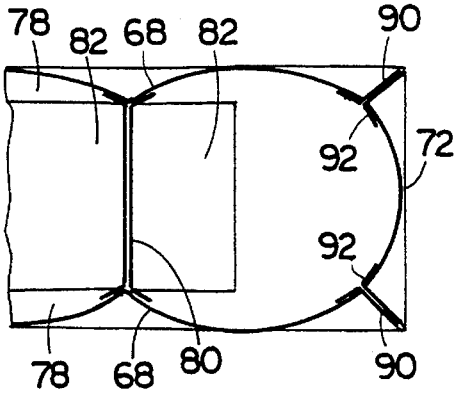
FIG. 5 is an enlarged side view of one portion of the air mattress of FIG. 2.

FIG. 5 is an enlarged sectional view of FIG. 3. Referring to FIG. 5, it will be seen that baffle 80 has a substantially I-shaped structure (and thus is often referred to as an I beam) and is joined to fabric 68 at its top and bottom. Although not specifically illustrated in FIGS. 2 through 5, it is preferred that longitudinally-extending beams 82 also have an I-beam structure and also be joined at their tops and bottoms to fabric 68.

Referring again to FIG. 5, and in the preferred embodiment illustrated, the seams between the sides, the top, and the bottom of fabric 68 and 72 may be joined by conventional means such as, e.g., vulcanized butt seam 90 and lap seam 92.

In one preferred embodiment, all of the seaming used to form air core 16 is heat-vulcanized, and the fabric 68 is preferably a latex rubber with a fabric outer side to prevent stretching. The fabric outer side may consist, e.g., of cotton, of polyester, of a fabric blend of natural and/or synthetic fiber, a knit fabric, a warp fabric, and/or a nonwoven fabric. In one preferred embodiment, such fabric is knit poly(ethylene terephthalate).

Figure 6:
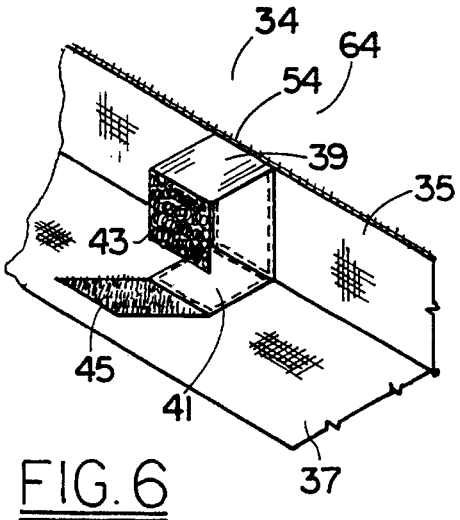
FIGS. 6 and 7 are partial perspective views of the cover rail straps of the system of FIG. 1.

FIG. 6 is a partial perspective view of cover 34. Referring to FIG. 6, it will be seen that cover 34 is comprised of side 35, bottom 37, top rail strap 39, and bottom rail strap 41. Referring to FIG. 6, it will be seen that, extending from the seam between zipper 54 and mattress cover side 35, fabric 39 is comprised of a loop section of VELCRO (synthetic material which adheres when pressed together) 43. Similarly, extending from the sewn seam between bottom 37 and side 35, fabric section 41 is comprised of a hook section of VELCRO 45. As will be apparent to those skilled in the art, VELCRO sections 43 and 45 can be pressed together to secure an object such as, e.g., support rail 40.

Figure 7:
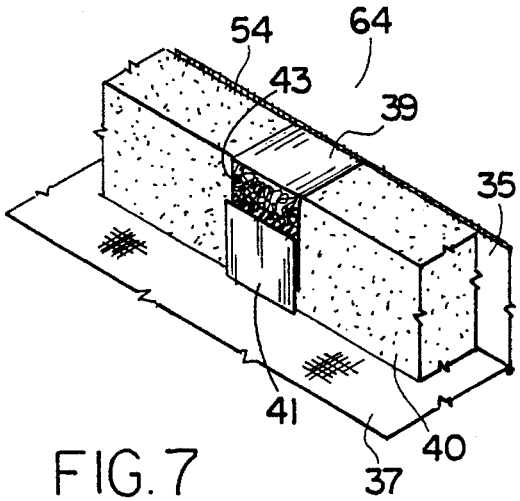

FIG. 7, and FIG. 1, both depict the rail strap assembly 64 in its closed position, supporting rail segment 40.

As will be apparent to those skilled in the art, other fastening means also may be used to secure the mattress edge support system 14. One such alternative means is illustrated in FIG. 8.

Figure 8:
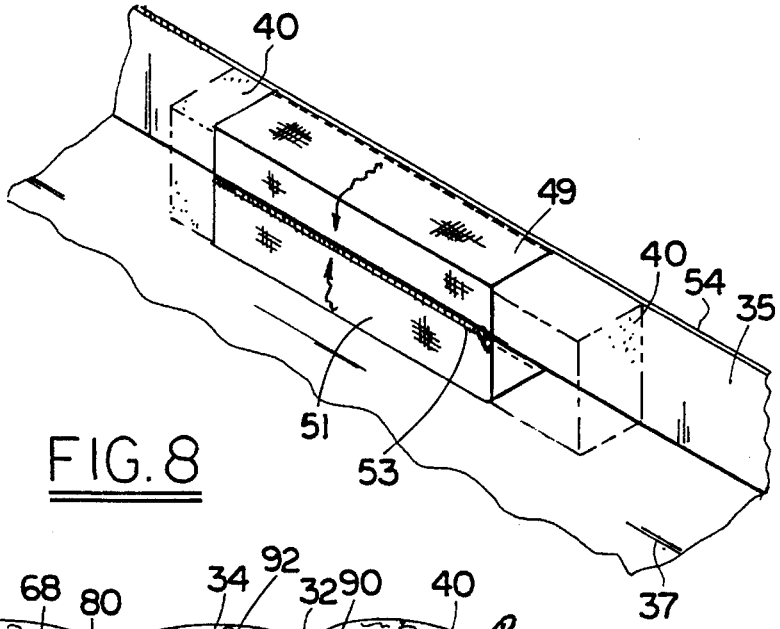
FIG. 8 is a partial perspective view of the cover rail sleeve of the system of FIG. 1.

Referring to FIG. 8, and in the preferred embodiment illustrated, fabric 49 is joined to fabric 51 by means of zipper 53, thereby enclosing and securing foam segment 40. It will be apparent to those skilled in the art that yet other fabric fastening means may be used, such as sewing, gluing, friction fit, and the like.

Thus, by way of further illustration, and referring to U.S. Pat. No. 4,991,244 (the entire disclosure of which is hereby incorporated by reference into this specification), the segments 38, 40, 42, and 44 may be joined together at their butt ends by VELCRO fasteners (see FIGS. 46*a*, 46*b*, 46*c*, and 46*d* of such patent).

Figure 9:
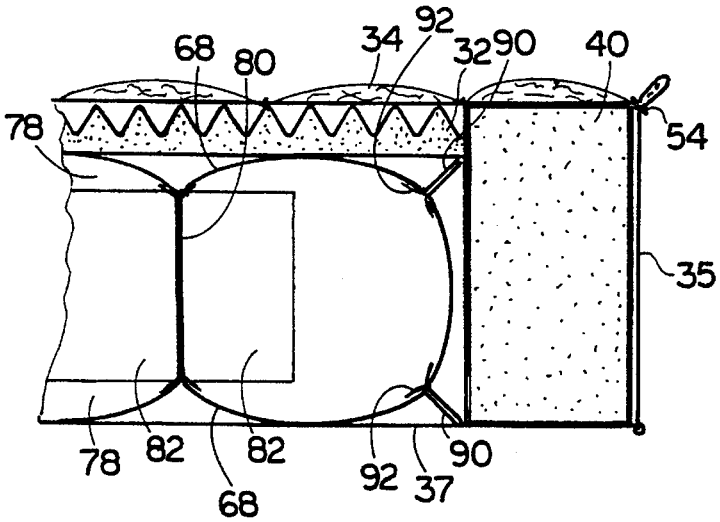
FIG. 9 is an partial enlarged side view of the air sleep system of FIG. 1.

FIG. 9 is a partial sectional view, similar to FIG. 5 but more detailed, illustrating the relationship of several of the components of air bedding system 10.

The Preferred Diaphragm Pump Used in the Sleep System

Figure 10:
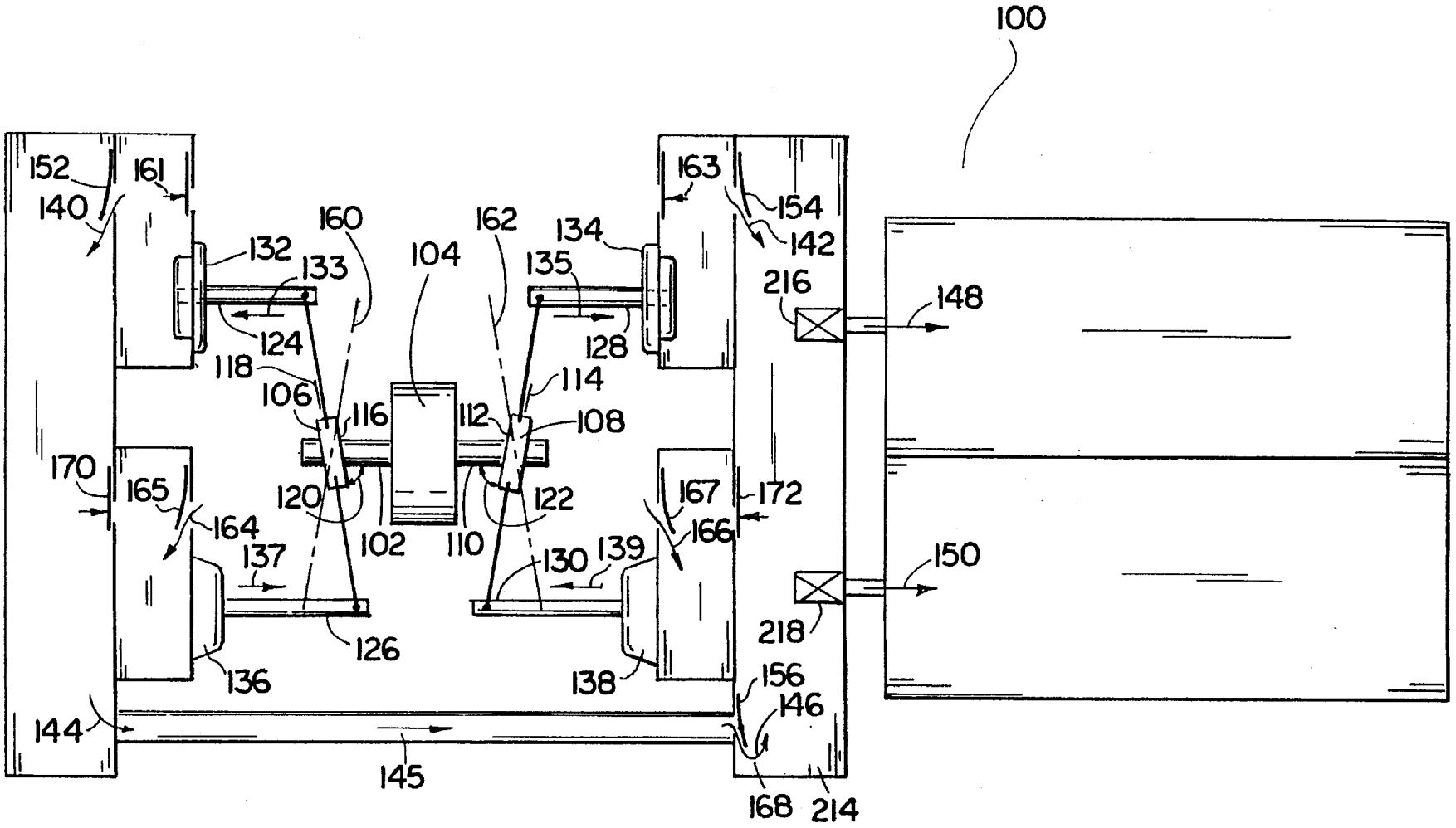
FIG. 10 is a schematic view of one preferred diaphragm pump used in the sleep system of FIG. 1.

FIG. 10 is a schematic representation of a preferred pump 100 used in applicant's sleep system. In this preferred embodiment, pump 100 is a diaphragm pump.

As is known to those skilled in the art, a diaphragm pump is a metering pump which uses a diaphragm to isolate the pumped parts from pumped air. These pumps are well known to those skilled in the art and are described, e.g., in U.S. Pat. Nos. 5,104,298, 5,096,392, 5,074,757, 5,073,092, and the like. The disclosure of each of these United States patents is hereby incorporated by reference into this specification.

Referring to FIG. 10, and the preferred pump 100 schematically illustrated therein, it will be seen that pump 100 is comprised of a means for rotating shaft 102, such as, e.g., motor 104.

Motor 104 preferably is an alternating current electric motor which, when supplied with 120 volt 60 cycle alternating current, will rotate at a speed of less than 3,300 revolutions per minute. Thus, the diaphragm pump of this invention is said to be comprised of means for rotating its shaft at a speed of less than 3,300 revolutions per minute. It is to be understood that, when said means language is used hereafter in this specification (and in the claims), it describes an apparatus which, when the motor driving the pump is supplied with 120 volt 60 cycle alternating power, will rotate at a speed of less than 3,300 revolutions per minute. It does not describe an apparatus which only is capable of rotating at a speed of less than 3,300 revolutions per minute when the motor driving the apparatus is supplied with a voltage less than 120 volts.

It is preferred that motor 104 rotate at a speed of less than 3,100 revolutions per minute. As is known to those skilled in the art, and by comparison, the motor driven impellers used to inflate the Select Comfort Corporations "Air Sleep System" rotate at least about 16,000 revolutions per minute when suppled with 120 volt, 60 cycles alternating current.

It is also preferred that, during its operation, motor 104 will draw at least about 100 watts of power. In general, motor 104 will draw from about 100 to about 200 watts of power during its operation.

As is known to those skilled in the art, one may use direct current motors, 120 volt universal motors, shaded pole induction motors, and the like, as motor 104.

Thus, by way of illustration, and in one preferred embodiment, motor 104 may be a shaded pole motor. As is known to those skilled in the art, a shaded pole motor is a single-phase induction motor having one or more auxiliary short-circuited windings acting on only a portion of the magnetic circuit. Generally the winding is a closed copper ring embedded in the face of a pole. The shaded pole provides the required rotating field for starting purposes.

Shaded pole induction motors are well known to those skilled in the art and are described, e.g., in U.S. Pat. Nos. 5,043,612, 5,036,237, 4,795,931, 4,689,508, 4,658,692, 4,531,072, 4,496,869, 4,482,832, and the like. The disclosure of each of these patents is hereby incorporated by reference into this specification.

In one preferred embodiment, motor 104 is a shaded pole induction motor available as model number P-15129 from the Uppco Corporation of 302 North Sixth Street, Monticello, Ind. 47960-1839.

Alternatively, motor 104 may be a universal motor which may be operated at approximately the same speed and output on either direct current or single-phase alternating current. Such motors are described, e.g., in U.S. Pat. Nos. 5,071,069, 5,063,319, 5,043,594, 5,040,950, 5,039,973, 5,091,928, and the like; the disclosure of each of these patents is hereby incorporated by reference into this specification.

Alternatively, motor 104 may be a permanent magnet, direct current motor such as, e.g., those described in U.S. Pat. Nos. 5,109,172, 5,109,171, 5,105,113, 5,077,823, 5,072,144, 5,070,269, and the like. The description of each of these patents is hereby incorporated by reference into this specification.

Alternatively, motor 104 may be a solenoid motor such as, e.g., those motors described in U.S. Pat. No. 5,052,792, in U.S. Pat. Nos. 4,986,738 and 5,062,169, in U.S. Pat. No. 4,897,890 (see FIG. 2), and the like. The disclosure of each of these United States patents is hereby incorporated by reference into this specification.

Referring again to FIG. 10, it will be seen that shaft 102 is connected to motor 104. Attached to shaft 104 is a first flange 106 and, in one preferred embodiment, a second flange 108. Although the use of two such flanges is preferred, and often leads to quieter and/or quicker operation, a shaft with only one such flange also will function well. Although the remainder of the discussion in this specification will refer to an embodiment in which two such flanges are present, it is to be understood that a device with only one such flange also is within the scope of the invention.

As is known to those skilled in the art, a flange is a projecting rim of a mechanical part, such as shaft 102. As will be apparent to those skilled in the art, and in the embodiment illustrated in FIG. 10, flanges 106 and 108 each form an obtuse angle with shaft 102. Thus, referring again to FIG. 10, it will be seen that the center line 110 of shaft 102 forms an obtuse angle 112 with centerline 114 of flange 108 and, similarly, forms an obtuse angle 116 with center line 118 of flange 106.

It will be apparent to those skilled in the art that flange 106 and flange 108 can also form an acute angle with shaft 102. In fact, either or both of such flanges can form any angle other than 90 degrees with shaft 102, and the angle formed by one flange may (but need not be) identical to the angle formed by the other flange.

In one preferred embodiment, each of flanges 106 and/or 108 forms an acute angle of from about 10 to about 30 degrees (and, more preferably, from about 15 to about 25 degrees) with shaft 102. In one preferred aspect of this embodiment, each of flanges 106 and/or 108 form an identical angle of from about 18 to about 22 degrees with shaft 102.

In one preferred embodiment, each of flanges 106 and/or 108 is part of an integral plastic assembly (not shown) comprised of a central tube and, integrally connected thereto and disposed at an acute angle to the axis of such tube. This plastic assembly may be friction fit onto shaft 102.

As will be apparent to those skilled in the art, as shaft 102 rotates, the angle formed between the top of the shaft and the flange(s) will change from an obtuse angle to an acute angle. Thus, the angles 120 and 122 which are presently formed between the bottom surface of shaft 102 and the flange(s) will be transposed when the shaft rotates 180 degrees. Consequently, as flanges 106 and/or 108 rotate through 360 degrees, the angles they form with shaft 102 continually vary.

Referring again to FIG. 10, flange 106 is connected to connecting rods 124 and 126, and flange 108 is connected to connecting rods 128 and 130. In the position shown in FIG. 10, as flange 106 and flange 108 rotate clockwise, connecting rods 124 and 128 depress diaphragms 132 and 134 in the direction of arrows 133 and 135 while, simultaneously, connecting rods 126 and 130 pull open diaphragms in the directions of arrows 137 and 139. During this portion of the cycle, air will flow in the directions of arrows 140, 142, 144, 145, 146, 148, and 150. The air flow during this cycle will cause flapper valves 152, 154, 156, 165, and 167, to open.

As the shaft 102 rotates 180 degrees, the flanges will assume the position depicted in dotted lines 160 and 162, and air will flow through flapper valves 170, 161, 172, 163 156, 148, and 150 and cause such valves to open.

Referring again to FIG. 10, and in the embodiment illustrated, each of flanges 106 and 108 is connected to both an upper diaphragm (such as diaphragms 132 and 134, respectively) and a lower diaphragm (such as diaphragms 136 and 138, respectively). In one embodiment, not shown, only one of flanges 106 and 108 is used. In either case, regardless of whether one flange and two diaphragms, or two flanges and four diaphragms, are used, applicant's pump during its operations continuously is delivering a specified volume of air to the air mattress through one of the diaphragms connected to each such flange while, simultaneously, intaking air at the same rate through the other of the diaphragms connected to each such flange. Without wishing to be bound to any particular theory, applicant believes that the use of such a dual diaphragm/flange arrangement, together with the use of a drive means which rotates at a speed of less than 3,300 revolutions per minute, allows the pump of his system to operate in an unexpectedly efficient and quiet manner.

In one preferred embodiment, pump 100 preferably delivers from about 110 to about 150 cubic inches of air per second and, more preferably, delivers from about 130 to about 150 cubic inches of air per second.

Figure 11:
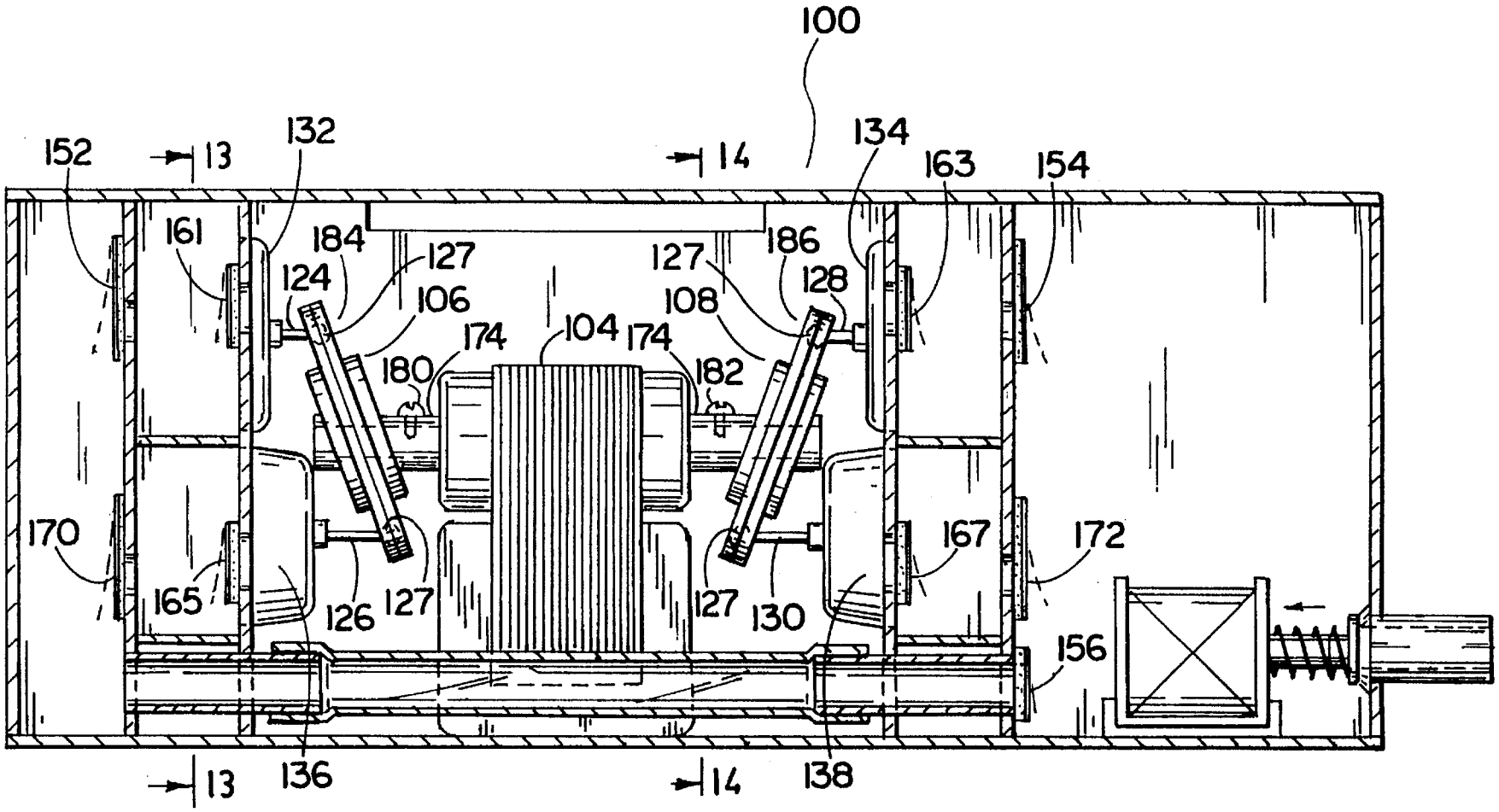
FIG. 11 is a sectional view of the pump of FIG. 10.

FIG. 11 is a sectional view of another preferred embodiment of pump 100. Referring to FIG. 11, it will be seen that, in this embodiment, each of flanges 106 and 108 is a three-piece assembly which is comprised of a sleeve 174 integrally connected to inner flanges 176 (not shown in FIG. 11, but see FIG. 15) which forms an angle other than ninety degrees with sleeve 174.

Referring again to FIG. 11, sleeve 174 is comprised of an orifice (not shown) which allows it to fit over shaft 102. In the embodiment illustrated in FIG. 11, sleeve 174 is connected to shaft 102 by means of fasteners 180 and 182. In another embodiment, now shown, sleeve 174 is connected to shaft 102 by means of a friction fit.

Referring again to FIGS. 11 and 15, it will be seen that outer flanges 184 and 186 are connected to connecting rods 124, 126 and 128, 130, respectively. Connecting rod 124, 126, 128, and 130 are connected to diaphragms 132, 136, 134, and 138, respectively.

Figure 15:
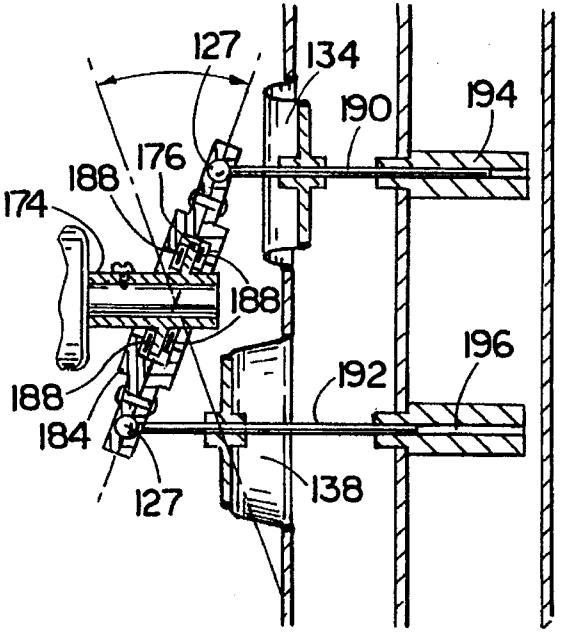
FIG. 15 is a sectional view of the shaft mechanism of the pump of FIG. 10.

Referring again to FIG. 11, it will be seen that each of the connecting rods 124, 126, 128, and 130 is connected to the flange assembly 106 or 108 by means of a ball and socket assembly 127 which allows the outer flange to pivot around the connecting rod (see FIG. 15).

As shaft 102 (not shown) rotates, sleeve 174 rotates at the same speed, thereby causing inner flange 176 (see FIG. 15) to rotate at the same speed.

The outer flange 184 is attached to the inner flange 176 so that, during the rotation of inner flanges 176 the outer flange is caused to produce reciprocating linear motion with the connecting rods to which it is attached (see FIG. 15). One preferred means of such attachment is illustrated in FIG. 15.

Referring again to the preferred embodiment depicted in FIG. 11, it will be seen that diaphragm pump 100 preferably is comprised of a pressure relief valve 171 which, in this embodiment, is provided with a spring 173 mounted on a shaft 175. As the air pressure within the housing 234 exceeds a certain predetermined value, then pressure relief valve 171 will open and exhaust air to atmosphere.

In one preferred embodiment, the pressure relief valve opens when the pressure within housing 234 exceeds a pressure of from about 1 to about 1.25 pounds per square inch in excess of atmospheric pressure.

As will be apparent to those skilled in the art, other pressure relief valves in addition to the one depicted in FIG. 11 may be used in the apparatus. Thus, by way of illustration and not limitation, one may use the pressure relief valves disclosed in U.S. Pat. Nos. 4,644,597, 4,995,173, 4,991,317, 4,977,891, 4,954,051, 4,920,971, and the like. The disclosure of each of these patents is hereby incorporated by reference into this specification.

Referring again to FIG. 15, and in the preferred embodiment illustrated therein, it will be seen that inner flange 176 is disposed within outer flange 184 and separated therefrom by roller bearings 188. Thus, as inner flange 176 rotates and changes its angular disposition visa vis shaft 102, outer flange 184 is free to slide over the outer surface of inner flange 176.

Referring again to FIG. 15, outer flange 184 is connected by rods 190 and 192 to diaphragms 134 and 138 (not shown in FIG. 15, but see FIG. 11). Rods 190 and 192 are disposed within guides 194 and 196 which confine their motion to linear motion. Thus, because of such confinement, the forces transmitted from inner flange 176 to outer flange 184 result in reciprocating linear motion of rods 190 and 192.

In the preferred embodiment illustrated in FIG. 15, each of retaining rods 190 and 192 are preferably connected to diaphragms 134 and 138 by means of connecting disks (not shown in FIG. 15). These connecting disks, and the means by which they interact with the diaphragms, are illustrated in FIGS. 15A and 15B.

Figure 15A:
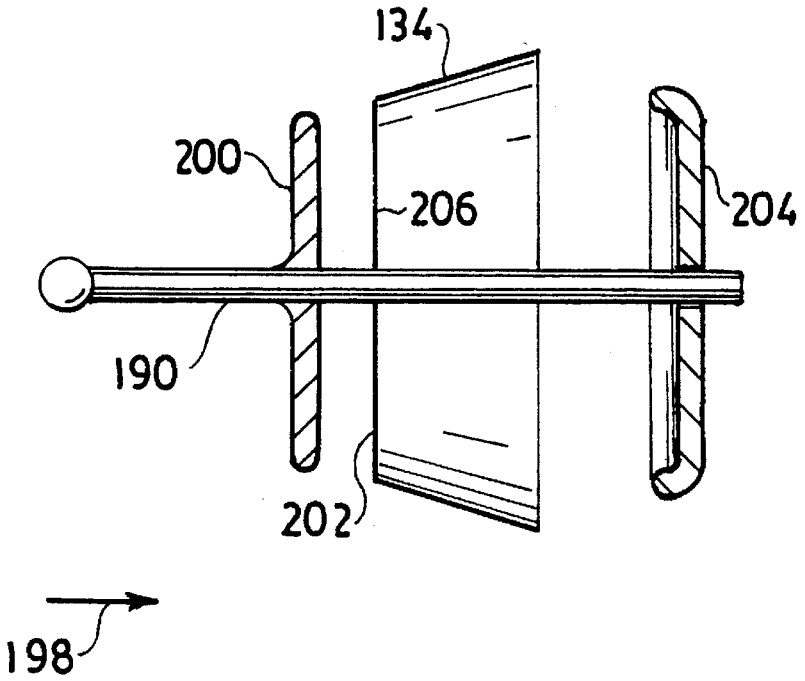
FIG. 15A is a partial sectional view of a connecting rod/retaining plate/diaphragm assembly in an open position.

FIG. 15A is an exploded view of the retaining rod assembly before it is constructed and used. Referring to FIG. 15A, as connecting rod 190 is moved in the direction of arrow 198 because of the sliding motion of outer flange 186 (not shown in FIG. 15A), disc 200 is also moved in the direction of arrow 198. In the embodiment illustrated, disk 200 is integrally connected to rod 190.

As disk 200 approaches the front face 202 of diaphragm 134, it causes such front face 202 to move towards retaining disk 204 and eventually causes back face 206 of diaphragm 134 to contact and be deformed by retaining disk 204.

Figure 15B:
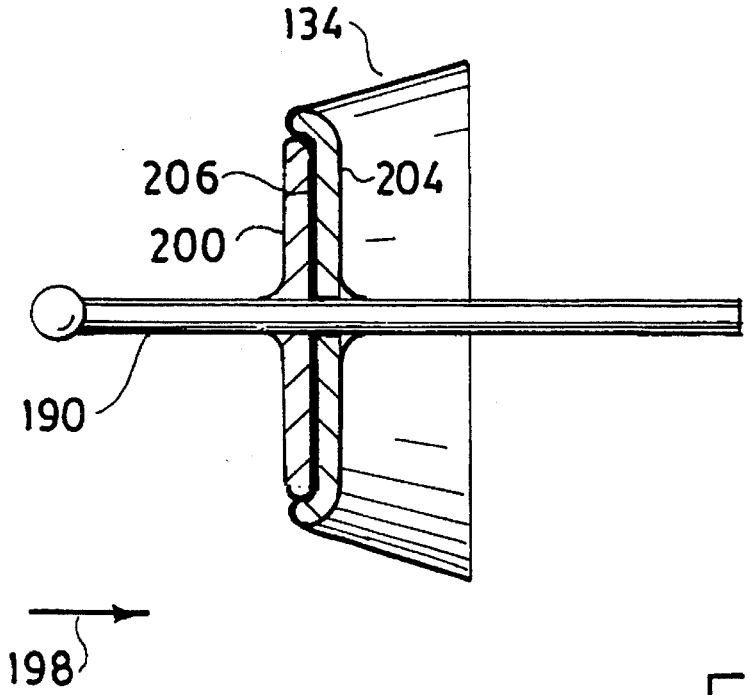
FIG. 15B is a partial sectional view of a connecting rod/retaining plate/diaphragm assembly in a closed position.

FIG. 15B illustrates the situation which occurs when the retaining rod 190 has reached the limit of its linear travel in one direction and the assembly is ready for use. Referring to FIG. 15B, the front face 202 and the back face 206 of diaphragm 134 have been sandwiched between disk 200 and disk 204 and caused to conform to the contours of such disks.

Figure 12:
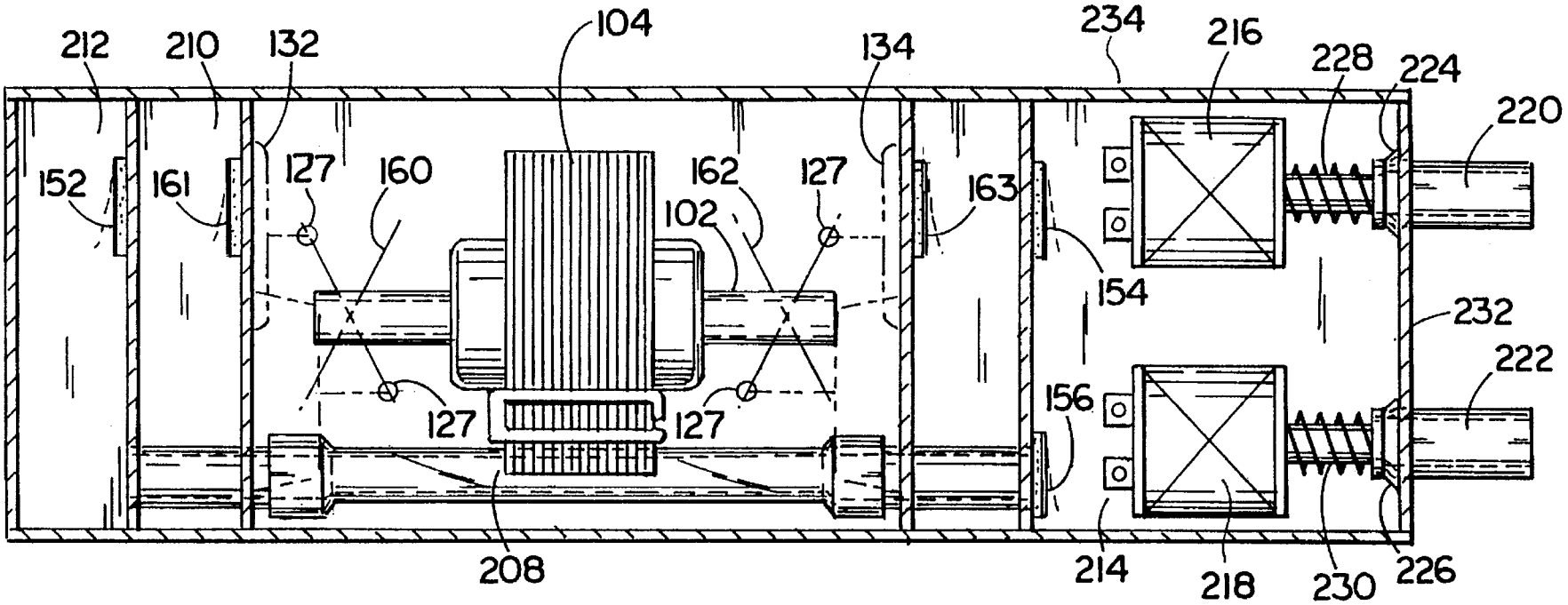
FIG. 12 is a top view of the pump of FIG. 10.

FIG. 12 is a sectional view of one preferred pump assembly 100 from which some detail regarding flanges and diaphragms have been omitted for the sake of clarity.

Referring to FIG. 12, and in the preferred embodiment illustrated therein, the air flow produced by diaphragms 132 and 135 can only escape through tube 208 after first having flowed into chamber 210, thence through flapper valve 152 into chamber 212 and thence in the direction of arrows 144 and 145 (see FIG. 10) and through flapper valve 156 into solenoid valve chamber 214. By comparison, the air flow produced by diaphragms 134 and 138 escapes through flapper valves 154 and 172 into solenoid chamber 214.

Disposed within solenoid chamber 214 are solenoids which, upon actuation, allows air to flow into either tube 220 and/or tube 222.

Referring again to FIG. 12, each of solenoids 216 and 218 are preferably connected to a separate control means (not shown) which preferably controls the flow to one portion of the air mattress; said control means is also connected to electrical motor 104. When either of solenoids 216 or 218 is connected to the "soft" setting of the control means, the solenoid is activated to open either rubber valve 224 or 226, thereby allowing air to escape from the air mattress (not shown in FIG. 12) back through the pump and through an upper port (not shown in FIG. 12). When either of solenoids 216 or 218 is connected to the "hard" setting of the control means, the rubber valves 224 or 226 are opened and, simultaneously, motor 104 is acutated, thereby pumping air through said valves into the air core.

When the control means is neither in the "soft" or the "hard" settings, then power to the solenoids ceases to be delivered, springs 228 and/or 230 cause rubber valves 224 and/or 226 to close, and air does not flow into or out of the mattress.

Figure 14:
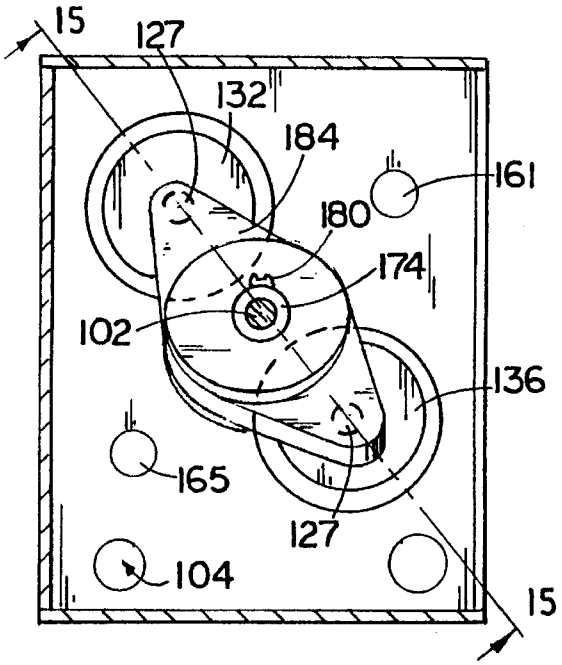
FIG. 14 is sectional view of the diaphragm/diaphragm housing combination of the pump of FIG. 10.
Figure 13:
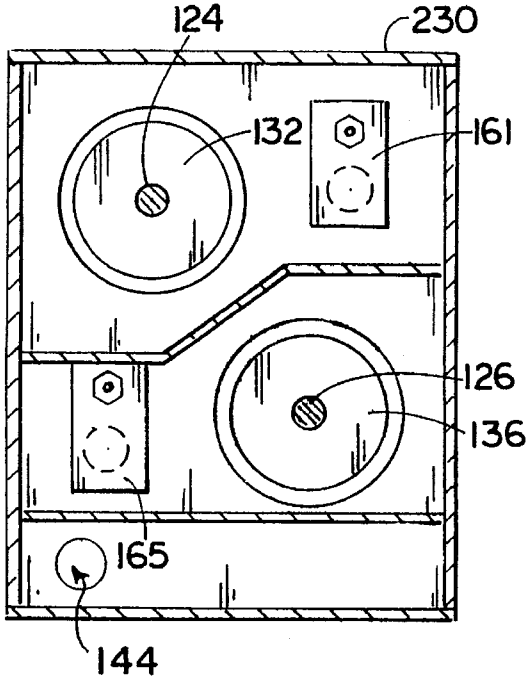
FIG. 13 is a sectional view of the diaphragm housing of the pump of FIG. 10.

FIG. 13 is a partial inner view of a diaphragm housing 230. FIG. 14 is a partial outer view of the diaphragm housing 230, illustrating the side facing motor 104.

Referring again to FIG. 12, it will be seen that, in the embodiment depicted, rubber valves 224 and 226 allow the passage of air through the front side 232 of the pump housing 234. It will be apparent to those skilled in the art that the location of the air flow ports may be varied. Thus, in the embodiment depicted in FIG. 16, from which certain detail has been omitted from the sake of simplicity, port 220 extends through the mattress side of the pump. Thus, e.g., in the embodiment depicted in FIG. 17, from which certain detail has been omitted for the sake of simplicity, the ports 220 and 222 extend through the top 238 of pump housing. Other suitable porting arrangements will be readily apparent to those skilled in the art.

Figure 18:
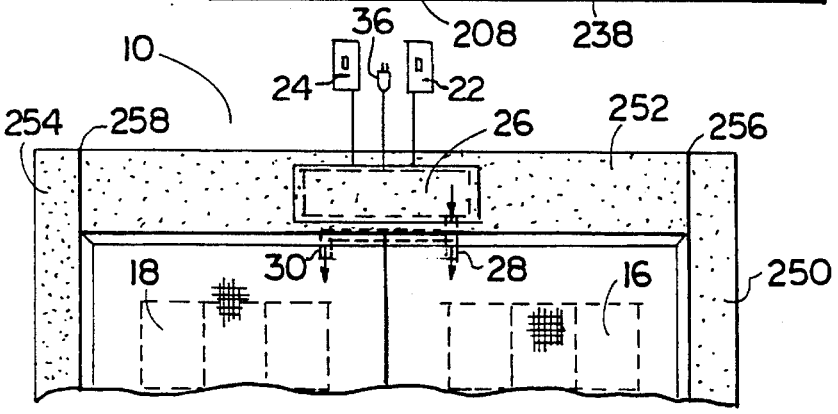
FIG. 18 is a top schematic view of one embodiment of applicant's sleep system.
Figure 19:
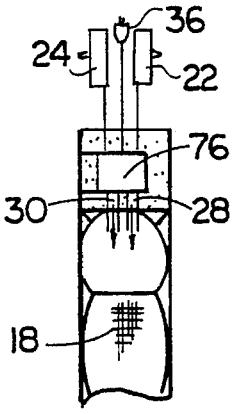
FIG. 19 is a side view of the sleep system of FIG. 18.

FIG. 18 is a partial top view of bed assembly 10 in which foam side rails 250, 252, and 254 are joined by VELCRO fasteners (not shown) at junctions 256 and 258. In this embodiment, the ends of the foam side rails are not mitered (compare the embodiment of FIG. 1), and air hoses 28 and 30 are disposed somewhat differently within the assembly, FIG. 19 is a longitudinal sectional view of the air bed assembly of FIG. 18.

Figure 16:
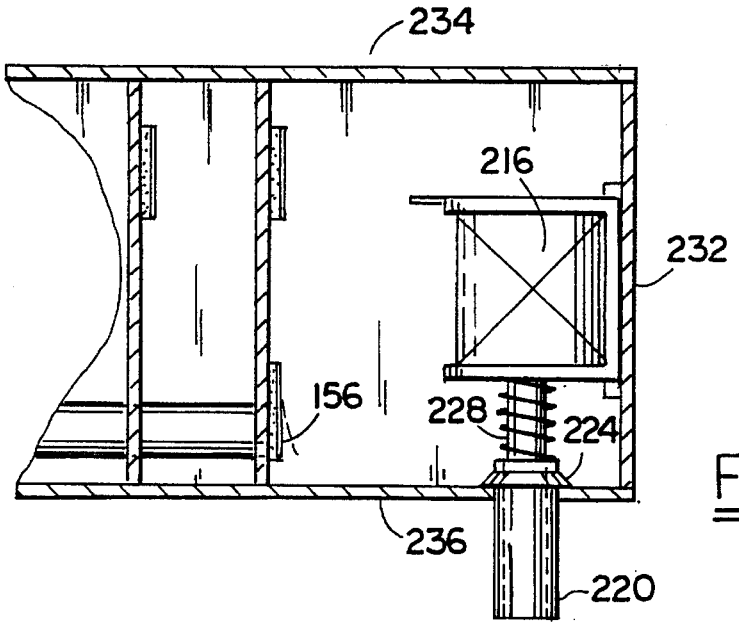
FIG. 16 is a partial sectional view of an exhaust port of the pump of FIG. 10.
Figure 17:
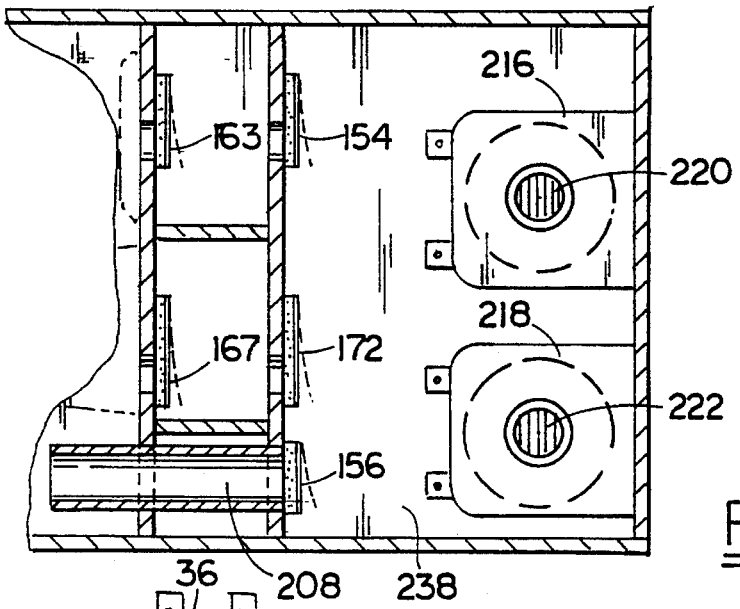
FIG. 17 is a partial sectional view of another embodiment of a diaphragm pump which may be used in the sleep system of FIG. 1.
Figure 20:
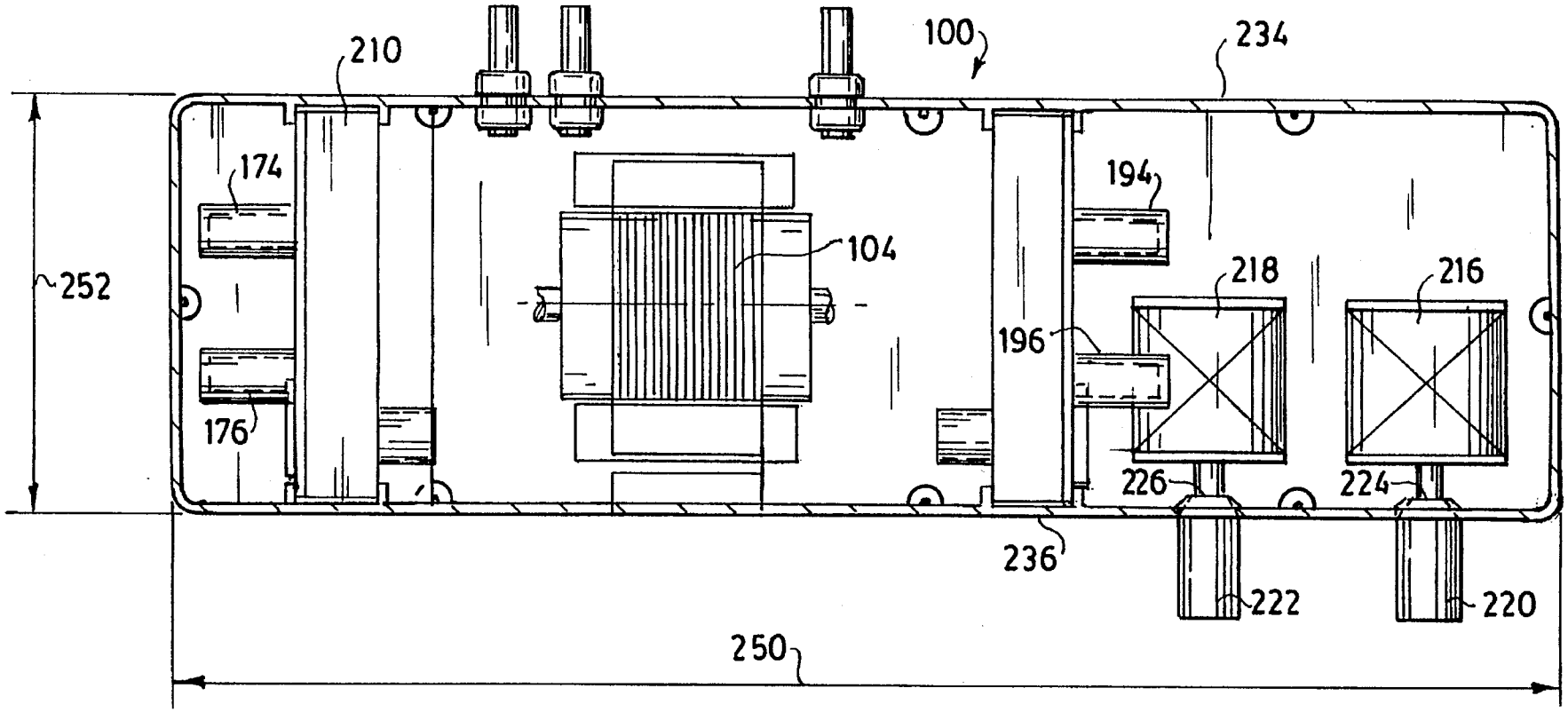
FIG. 20 is a top view of one preferred diaphragm pump.

FIG. 20 is a top sectional view of another embodiment of pump assembly 100 in which ports 220 and 220 extend through wall 236 rather than through wall 232 (compare this embodiment with the embodiment of FIGS. 16 and 12)

Referring again to FIG. 20, and in the preferred embodiment depicted, it will be seen that pump 100 has a length 250 of at least about 10 inches and, preferably, has a length of from about 10.75 to about 12.75 inches. The width 252 of pump 100 is preferably less than about 4.0 inches and, in one embodiment, is less than about 3.7 inches. The height 254 of pump 100 is preferably less than about 5.0 inches and, in one embodiment, less than about 4.75 inches (see FIG. 21).

Figure 21:
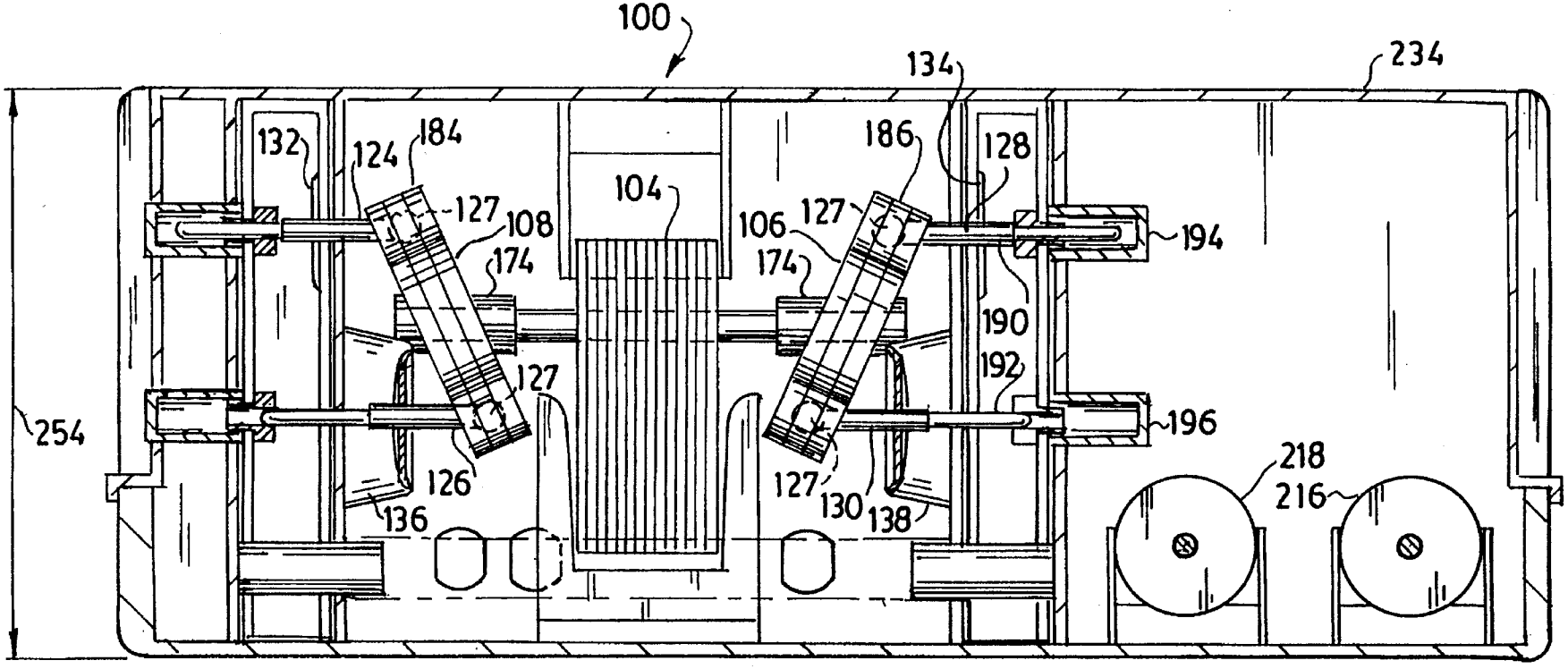
FIG. 21 is a side view of the diaphragm pump of FIG. 20.

FIG. 21 is a side view of the pump 100 of FIG. 20 in which the flanges 106 and 108 have been exploded to better illustrate their construction (also see FIG. 15).

It is preferred that pump 100 have a substantially rectilinear shape.

When pump 100 operates at 3,000 revolutions per minute, it produces less than 60 decibels of sound when measured with a standard decibel meter located 3.0 feet away from pump 100; by comparison, the pump used in the Select Comfort unit produces at least 80 decibels. Because a decibel is ten times the common logarithm of the ratio of two like quantities, a pump producing 80 decibels of sound is substantially noisier than one producing 60 decibels of sound.

As will be apparent to those skilled in the art, the decibel level of a pump may be determined with conventional sound meters such as, e.g., the sound meters sold as catalog numbers 332055 and 332050 by Radio Shack of, e.g., Panorama Plaza, Penfield, N.Y. 14625.

In one embodiment, not shown, the pump 100 is powered by a battery pack which also is preferably disposed within the air mattress.

Figure 22:
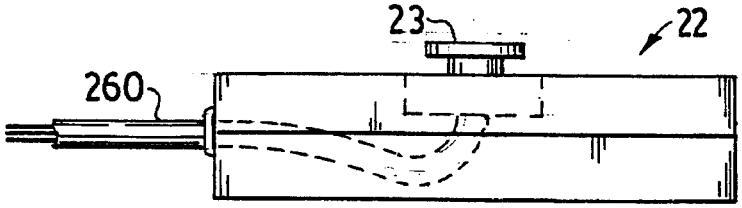
FIG. 22 is a side view of a hand-held controller device which can be used with the air mattress assembly of FIG. 1.

FIG. 22 is a side view of a hand-held controller device 22 which can be used with the air mattress assembly of FIG. 1. Referring to FIG. 22, it will be seen that controller 22 is comprised of a switch 23 which, when depressed or otherwise activated, sends a signal (not shown) through electrical wire 260 to diaphragm pump 26 (not shown in FIG. 22, but see FIG. 1).

It will be appreciated by those skilled in the art that other control units may also be used which are capable of causing air to either flow into or out of air cores 16 and/or 18. Thus, by way of illustration and not limitation, one may use the control units described in U.S. Pat. Nos. 4,394,784, 4,435,864, 4,489,297, 3,935,604, 4,998,939, 4,644,597, and 313,973; the disclosure of each of these patents is hereby incorporated by reference into this specification.

Figure 23:
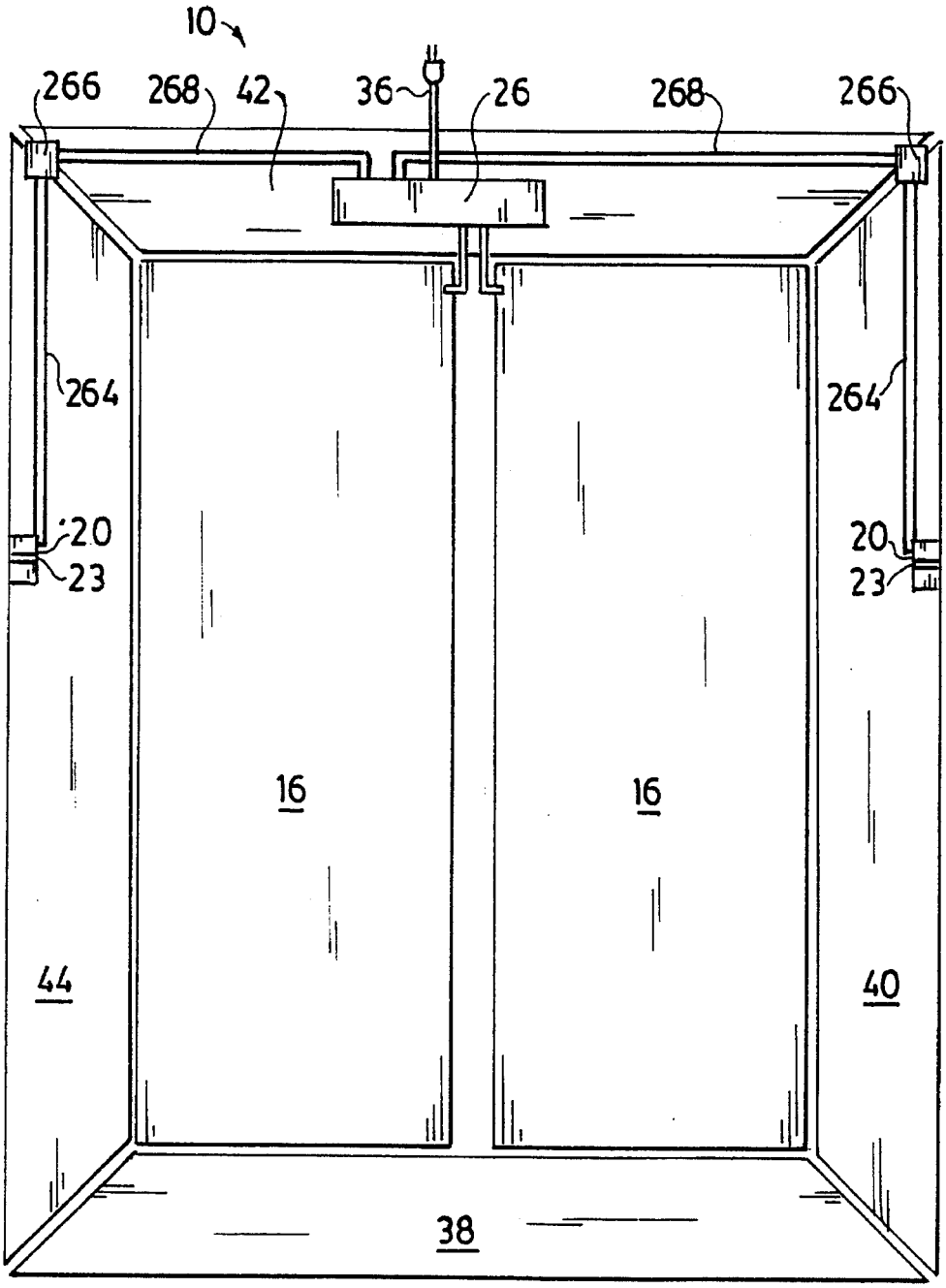
FIG. 23 is a schematic illustration of a flush-mountable controller device disposed within an air mattress assembly.

FIG. 23 is a schematic illustration of how a flush-mounted controller device may be disposed within an air mattress assembly. Referring to FIG. 23, a top view of a bedding assembly 10 (see FIG. 1) which contains a left and right flush-mounted controller 20 is shown. It be seen that each of such controllers is functionally similar to controller 22 (see FIG. 22) but differs in that controllers 23 are disposed within foam segments 40 and 44.

Referring again to FIG. 23, it will be seen that each of controllers 20 is connected via electrical wiring 264 to male/female connectors 266 (which may be, e.g., a standard three-pronged connector) and thence via wires 268 to diaphragm pump 26. It will be apparent to those skilled in the art that, because segments 38, 40, 42, and 44 are independent and may be removed from each other, it is desirable to have disconnectable male/female connectors between wiring 264 and 268 so that such connection can be readily disconnected when one desires to remove one segments 38, 40, 42, or 44.

Referring again to FIG. 23, and in the embodiment depicted, wiring 264 and 268 is disposed within the foam which comprises segments 40, 42, and 44. In another embodiment, not shown, wiring 264 and 268 is disposed outside of such foam.

Figure 24:
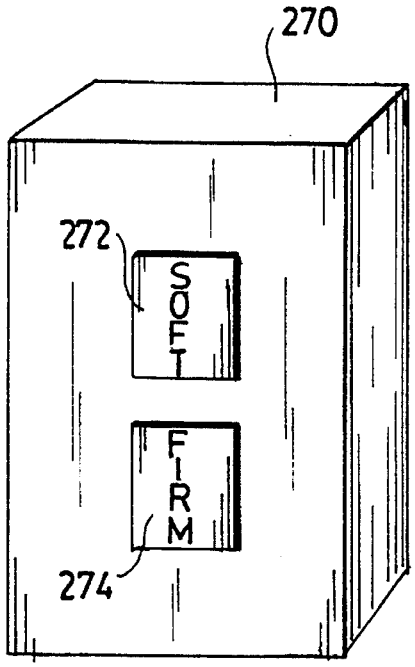
FIG. 24 is a top view of a remote controller device which may be used in conjunction with the air mattress assembly of FIG. 1.

FIG. 24 is a top view of a remote controller device which may be used in conjunction the air mattress assembly of FIG. 1. Referring to FIG. 24, it will be seen that controller 270 comprised of a "soft" switch 272 to allow air to exhaust from the air core (not shown) and a "firm" switch 274 to force air into the air core (not shown). As will be apparent to those skilled in the art, any of many conventional remote control devices for controlling the flow of air may be used as member 270. Thus, for example, one may use the remote controllers disclosed in U.S. Pat. Nos. 4,989,280, 5,105,488, and 5,052,894. The disclosure of each of these United States patents is hereby incorporated by reference into this specification.

Figure 25:
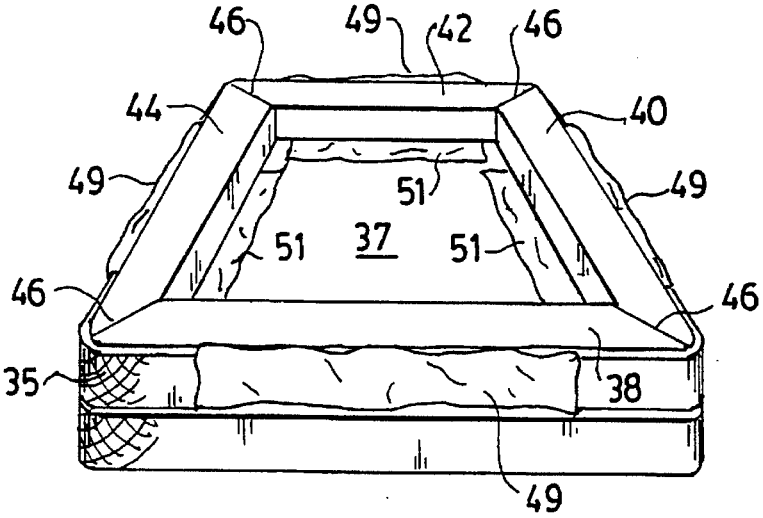
FIG. 25 is a perspective view of the foam mattress support system used in the air mattress assembly of FIG. 1.

FIG. 25 is a perspective view of the foam mattress support used in the air mattress assembly of FIG. 1.

Figure 26:
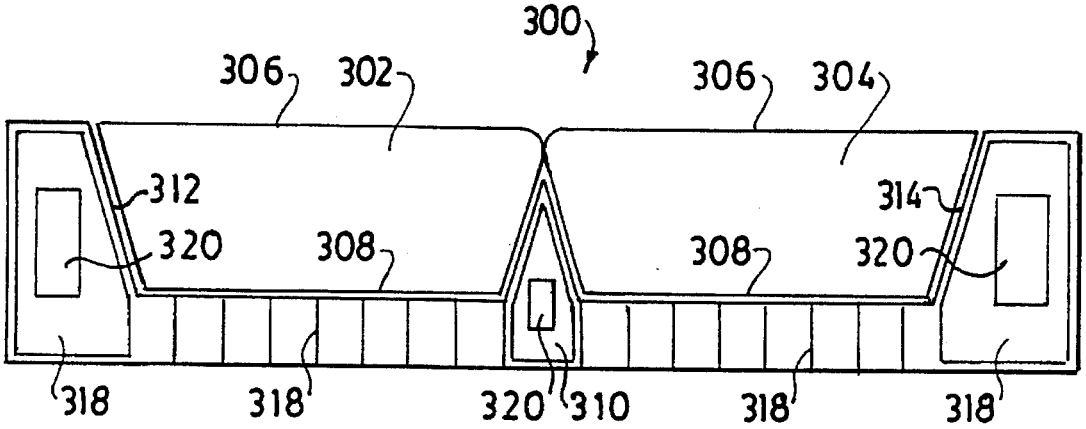
FIG. 26 is a sectional view of an air-filled mattress support system which may be used in place of the foam mattress support system of FIG. 25, and also of two air mattresses disposed within said system.

FIG. 26 is a sectional view of an air-filled mattress support system 300 which may be used in place of the foam mattress support system 14 (see FIG. 1).

Referring to FIG. 26, it will be seen that air cores 302 and 304 are nested within support system 300. In the embodiment depicted, each of air cores 302 and 304 are comprised of walls which extend inwardly from their top 306 to their bottom 308 and thus are adapted to mate with upwardly extending wedge 310 and upwardly and outwardly extending walls 312 and 314 and thus securely fit within the support system 300.

Figure 27:
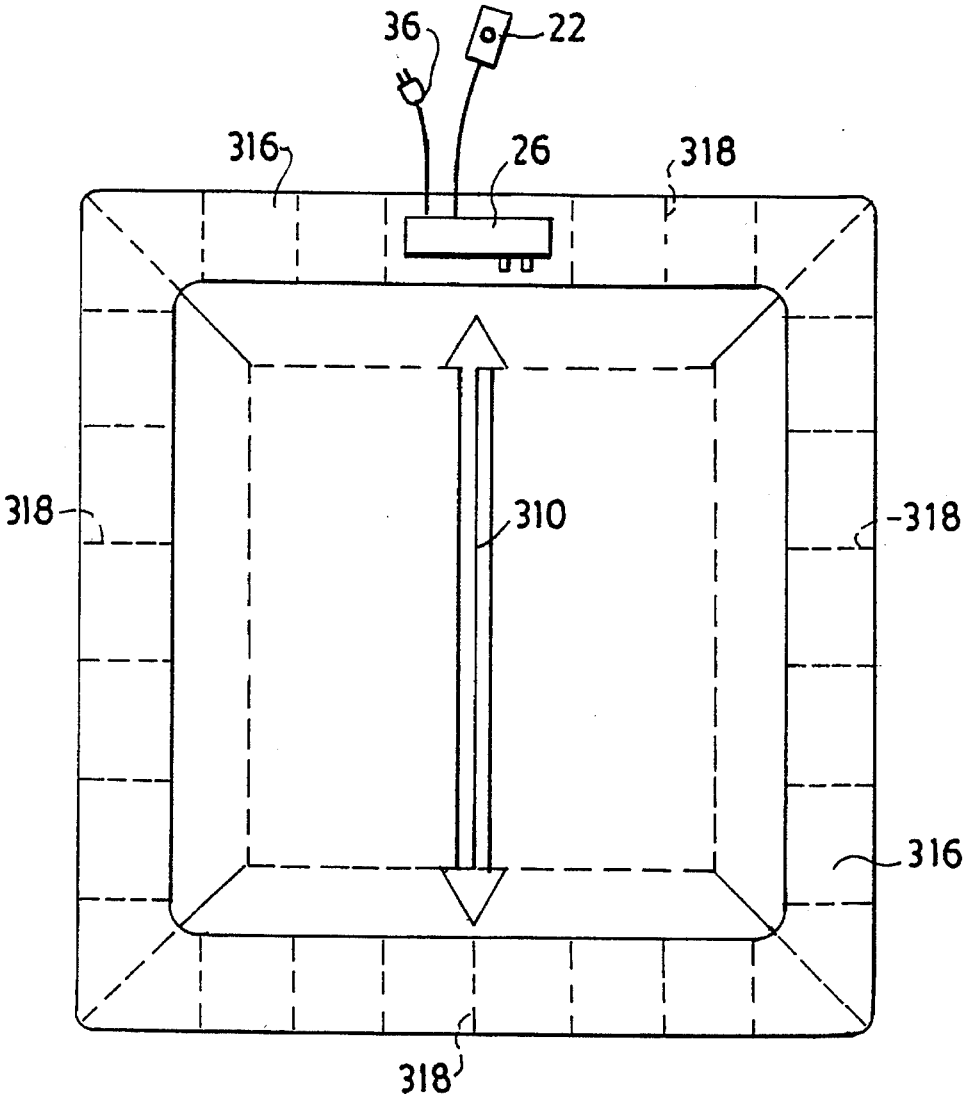
FIG. 27 is a top view of the air-filled mattress support system of FIG. 26.

Referring to FIG. 27, which is a top view of support system 300, it will be seen that the entire top perimeter 316 of support system 300 is comprised of air-pervious baffles 318 which, preferably, are perforated and which allow air to flow completely around the perimeter of such support system 300.

In the preferred embodiment illustrated in FIG. 26, it will be seen that baffles 318 are comprised of openings 320 to allow the passage of air through them.

Figure 28:
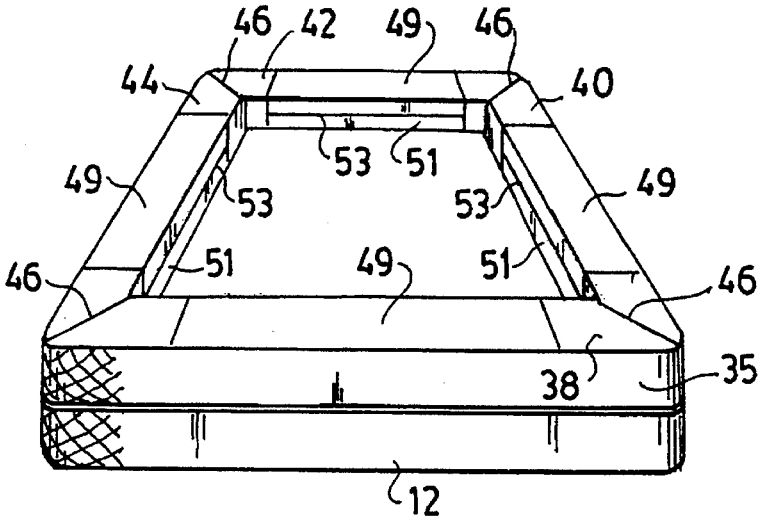
FIG. 28 is a perspective view illustrating how the foam rails of FIG. 8 may be disposed within the air mattress assembly of FIG. 1.

FIG. 28 is a perspective view illustrating how the foam rails of FIG. 8 may be disposed in the air mattress assembly of FIG. 1. Referring to FIG. 28, it will be seen that form rail segments 38, 40, 42, and 44 are disposed on foundation 12.

Figure 29:
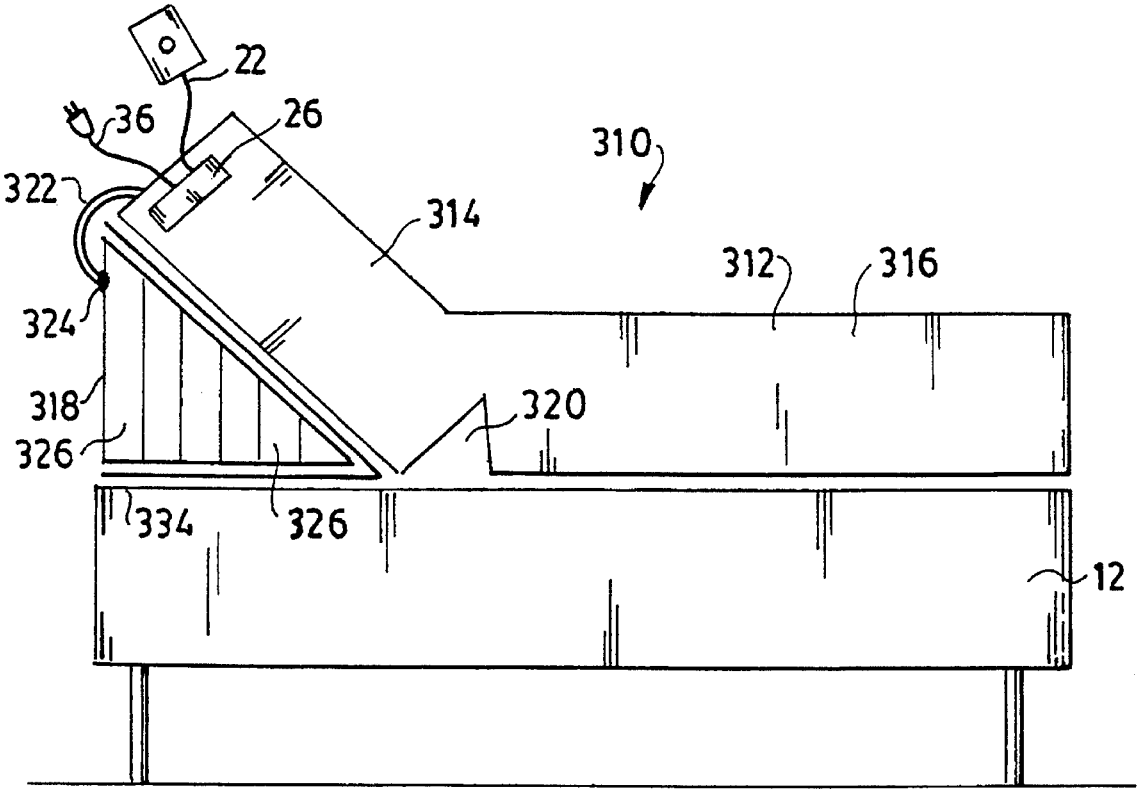
FIG. 29 is a side view of a mattress assembly the elevation of whose head section can be varied.

FIG. 29 is a side view of a adjustable bed assembly 310 comprised of a mattress 312 whose head portion 314 and/or whose foot portion 316 may be raised to any desired extent by the insertion of air into air wedge 318 and/or into a comparable air wedge (not shown) disposed under foot portion 316.

Referring to FIG. 29, it will be seen that mattress 312 preferably is comprised of at least two portions (such as head portion 314 and foot portion 316) which may be raised or lowered independently of each other. In the preferred embodiment depicted in FIG. 29, this independent movement is allowed by the presence of gusset-shaped opening 320.

As will be apparent to those skilled in the art, other means may be utilized to allow head portion 314 to fold upwardly substantially independently of foot portion 316. Thus, by way of illustration and not limitation, head portion 314 might be hingably attached to foot portion 316.

Referring again to FIG. 29, and in the preferred embodiment depicted, diaphragm pump 26 is preferably disposed entirely within mattress 312. In the embodiment illustrated, the diaphragm pump 26 is connected by an external hose 322 to air wedge 318. In another embodiment, not shown, hose 322 is primarily disposed within mattress 312.

The air wedge 318 is comprised of a multiplicity of vertically-extending air passages 326 (also see FIG. 30) which, when the wedge is fully inflated, causes it to attain its full triangular shape and, thus, increase its height. As will be apparent to those skilled in the art, when air wedge 318 is deflated, the distance 328 between its top 330 and its bottom 332 is substantially decreased.

Figure 30:
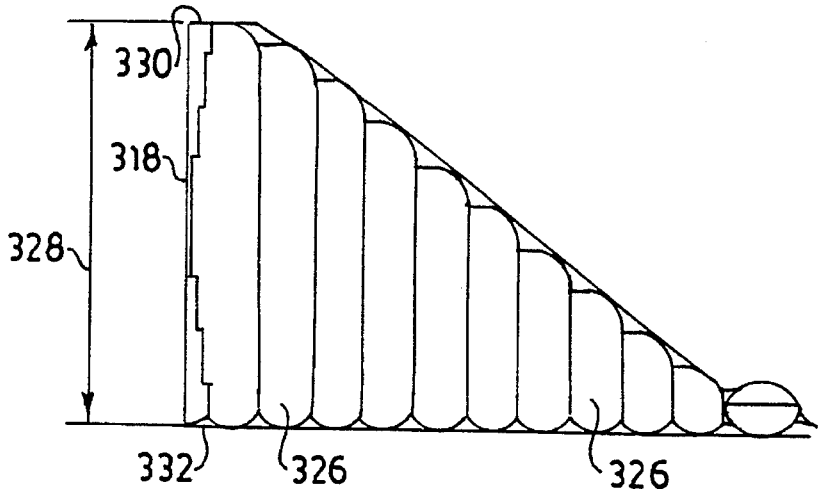
FIG. 30 is a sectional view of the inflatable baffle potion of the head section of the mattress of the assembly 29.

Referring again to FIG. 29, and also to FIG. 30, and in the preferred embodiment depicted therein, it will be seen that air wedge 318 is comprised of solid wall 324, and sold wall 334. The expansion of air compartments 326 causes sold wall 324 to raise upwardly and diagonally; and, because gravity causes head portion of mattress 312 to rest upon wall 324, such head portion 314 is also raised upwardly and diagonally. Conversely, as air is allowed to exhaust from wedge 318 (by means of controller 22), the air wedge 318, and the head portion 314 of mattress 312, is caused to move downwardly until the head portion 314 is substantially parallel to the foot portion 316. Thus, depending upon the amount of air which is caused to enter air wedge 318, a substantially infinite number of positions between the horizontal position of head portion 314 (when it rests on foundation 12) and the vertical position of head portion 314 (when it is substantially perpendicular to foot portion 316) are attainable.

In another embodiment, not shown, the foot portion 316 is itself divided into at least two sections which are movably connected to each other so that the distal end of foot portion 316 can be raised or lowered independently of the proximal end of portion 316. Other variations of this scheme will be apparent to those skilled in the art and are within the scope of this invention.

Figure 31:
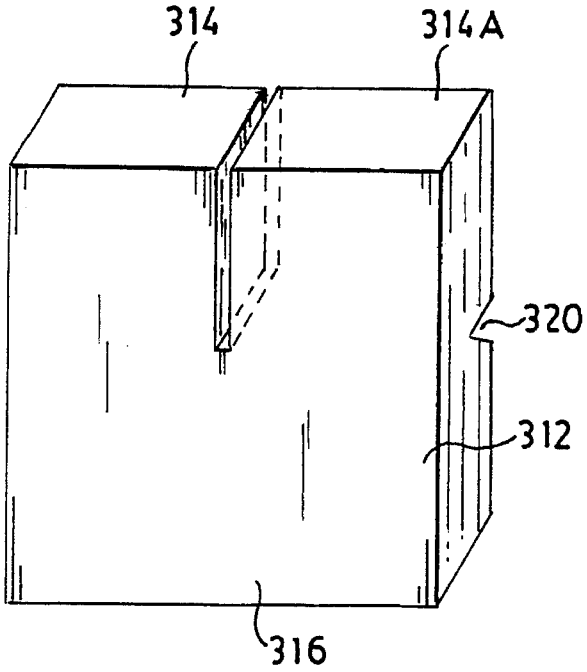
FIG. 31 is a top view of another preferred embodiment of a mattress assembly with two head sections, either one of which can be independently raised or lowered.

FIG. 31 is a top view of an air mattress 312 which can be used with the air wedges 318 (not shown in FIG. 31). It will be seen that air mattress 312 has two separate head sections 314 and 314*a*, each of which can be independently raised or lowered without substantially affecting foot section 316 and/or the other head section 314. Thus, in this embodiment, separate air wedges 318 (not shown) may be disposed under each head section 314, which then can be raised and/or lowered to different degrees and/or at different rates.

Figure 32:
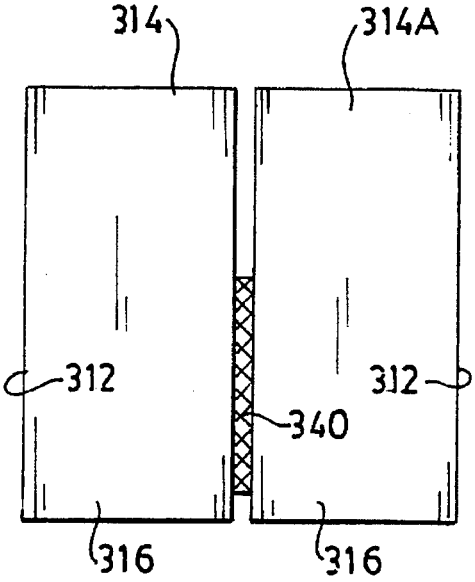
FIG. 32 is a top view of yet another preferred embodiment of a mattress assembly with two head sections, either one of which can be independently raised or lowered.

In the embodiment of FIG. 31, mattress 312 is a substantially integral structure. By comparison, in the embodiment of FIG. 32, two separate mattresses 312 are utilized and are joined together, e.g., by conventional means such as, e.g., a zipper 340. In this embodiment, each of the mattresses 312 is also comprised of means allowing its head section 314 to be raised or lowered independently of its foot section 316; and each of such head sections has an air wedge 318 disposed under it.

Figure 33:
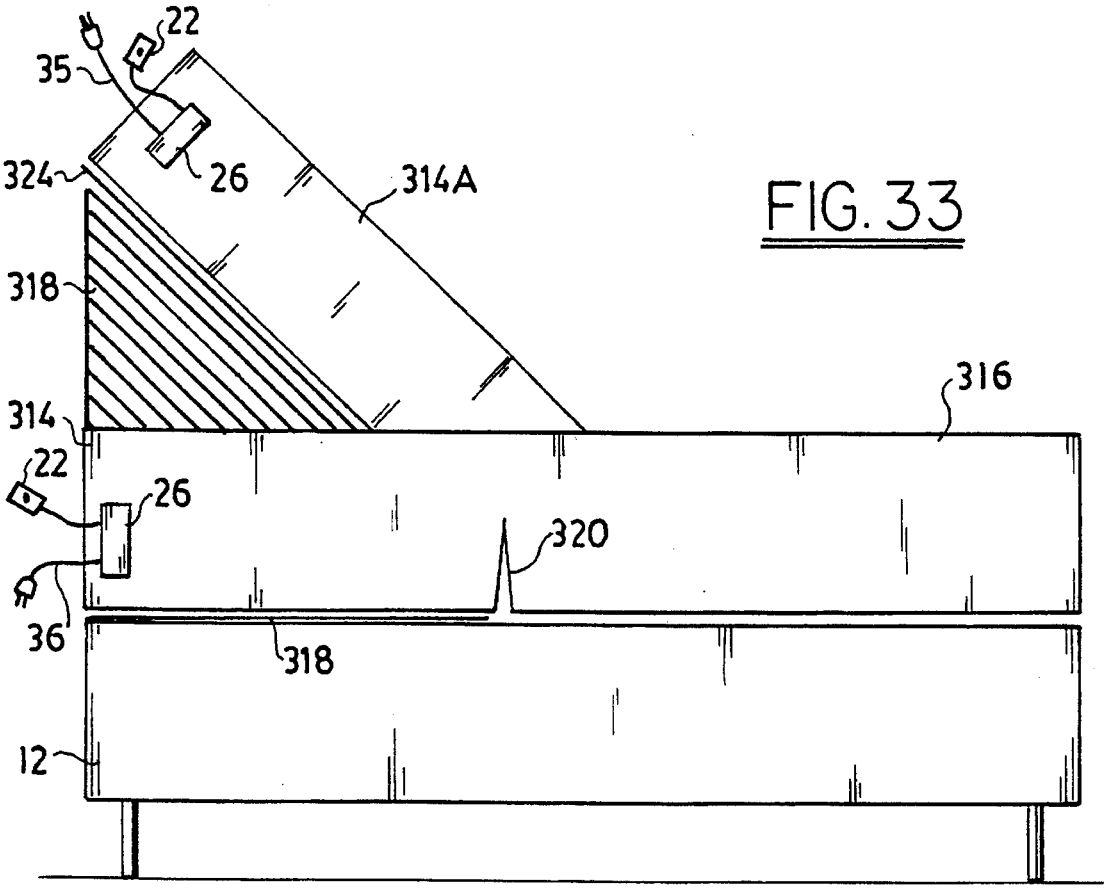
FIG. 33 is a side view of the mattress of FIG. 31.

FIG. 33 is a side view of the mattress of FIG. 31, illustrating one of such mattresses (with head section 314) in the reclining position, and the other of such mattresses (with head section 314*a*) in a diagonal position, being supported by air wedge 318. The air wedge 318 under head section 314 is shown in its deflated condition.

Figure 34:
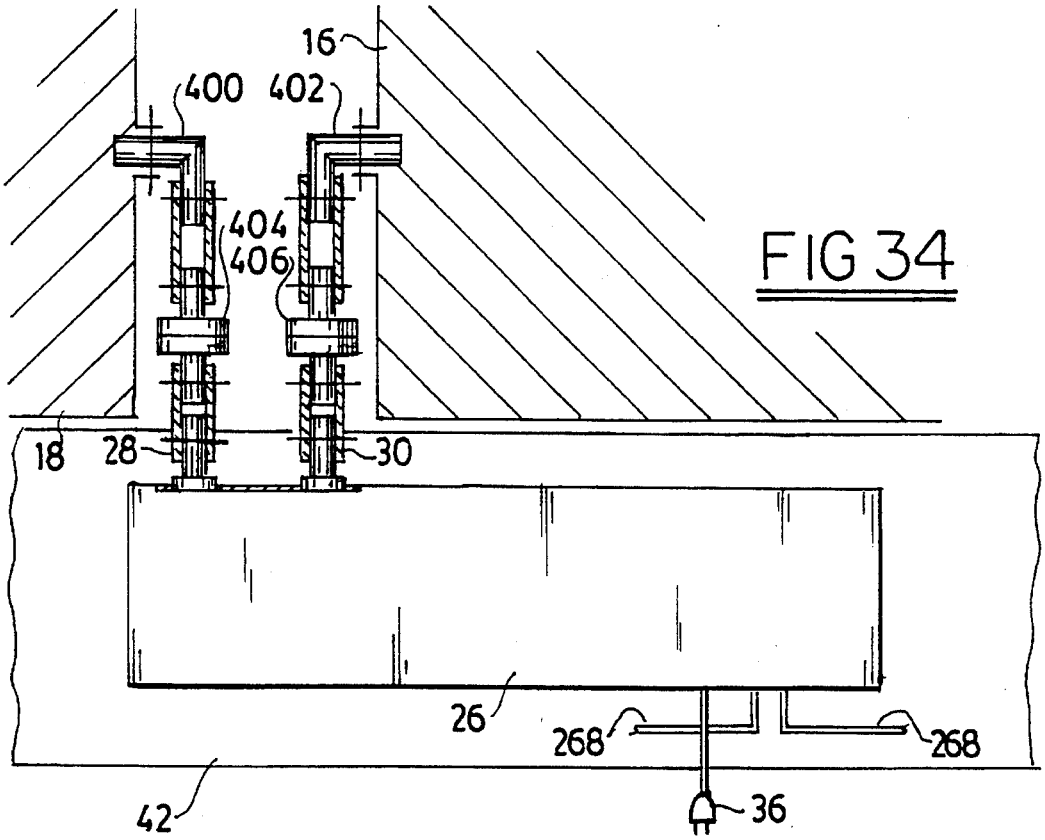
FIG. 34 is a partial, sectional view of air bedding assembly 10.

FIG. 34 is a partial, top sectional of air bedding assembly 10 illustrating how air hoses 28 and 30 may be connected to inport ports 400 and 402 of air cores 16 and 18 by means of preferred couplings 404 and 406.

As will be apparent to those skilled in the art, different hydraulic couplings may be used as couplings 404 and 406. In preferred embodiment, couplings 404 and 406 are APC ("all plastic couplings") produced by the Colder Products Company of 1001 Westgagte Drive, St. Paul, Minn.; thus, e.g., couplings APC-06 may be used.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A diaphragm pump comprised of a shaft, means for rotating said shaft at a speed of less than 3,300 revolutions per minute, a first flange assembly connected to said shaft such that the axis of rotation of said shaft forms an angle other than 90 degrees with the axis of rotation of said first flange assembly, a second flange assembly connected to said shaft such that the axis of rotation of said shaft forms an angle other than 90 degrees with the axis of rotation of said second flange assembly, a first connecting rod connected to a first diaphragm, a second connecting rod connected to a second diaphragm, a third connecting rod connected to a third diaphragm, a fourth connecting rod connected to a fourth diaphragm, and means for converting rotary motion of said flange assemblies into reciprocating linear motion of both said first connecting rod, said second connecting rod, said third connecting rod, and said fourth connecting rod wherein:

(a) as said first connecting rod is moved in a first direction at a first rate of travel, said second connecting rod is simultaneously moved in a second linear direction at a second rate of travel, wherein said second rate of travel is equal to said first rate of travel, and said second linear direction is the opposite of said first linear direction, and (b) as said third connecting rod is moved in a third direction at a third rate of travel, said fourth connecting rod is simultaneously moved in a fourth linear direction at a fourth rate of travel, wherein said fourth rate of travel is equal to said third rate of travel, and said fourth linear direction is the opposite of said third linear direction;

(c) said first flange assembly is connected to each of said first connecting rod and said second connecting rod by means of a ball and socket assembly;

(d) said second flange assembly is connected to each of said third connecting rod and said fourth connecting rod by means of a ball and socket assembly;

(e) said first flange assembly is comprised of a first inner flange disposed within a first outer flange and separated from said first outer flange by first bearings; and (f) said second flange assembly is comprised of a second inner flange disposed within a second outer flange and separated from said second outer flange by second bearings; and (g) said first diaphragm communicates with a first inlet and outlet valve pair, said second diaphragm communicates with a second inlet and outlet valve pair, said third diaphragm communicates with a third inlet and outlet valve pair, and said fourth diaphragm communicates with a fourth inlet and outlet valve pair.

2. The diaphragm pump as recited in claim 1, wherein said means for rotating said shaft is a shaded pole motor.

3. The diaphragm pump as recited in claim 1, wherein said axis of rotation of said first flange forms a first angle of from about 10 to about 30 degrees with said axis of rotation of said shaft.

4. The diaphragm pump as recited in claim 3, wherein said axis of rotation of said second flange forms a second angle of from about 10 to about 30 degrees with said axis of rotation of said shaft.

5. The diaphragm pump as recited in claim 4, wherein said first angle is substantially equal to said second angle.

6. The diaphragm pump as recited in claim 5, wherein each of said first angle and said second angle is from about 18 to about 22 degrees.

7. The diaphragm pump as recited in claim 1, wherein each of said first flange and said second flange consists essentially of plastic.

8. The diaphragm pump as recited in claim 2, wherein each of said first connecting rod, said second connecting rod, said third connecting rod, and said fourth connecting rod is separately disposed within a guide which limits its motion to linear motion.

9. The diaphragm pump as recited in claim 2, wherein said pump has a length of at least about 10 inches.

10. The diaphragm pump as recited in claim 9, wherein said pump has a width of less than about 4 inches.

11. The diaphragm pump as recited in claim 10, wherein said pump has a height of less than about 5 inches.

* * * * *